US011970936B2

(12) United States Patent
Al-Dhafeeri et al.

(10) Patent No.: US 11,970,936 B2
(45) Date of Patent: Apr. 30, 2024

(54) METHOD AND SYSTEM FOR MONITORING AN ANNULUS PRESSURE OF A WELL

(71) Applicant: SAUDI ARABIAN OIL COMPANY, Dhahran (SA)

(72) Inventors: Abdullah M. Al-Dhafeeri, AlKhubar (SA); Shebl Fouad Abo Zkry, Al-Khafji (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 157 days.

(21) Appl. No.: 17/717,778

(22) Filed: Apr. 11, 2022

(65) Prior Publication Data

US 2023/0323771 A1 Oct. 12, 2023

(51) Int. Cl.
*E21B 47/117* (2012.01)
*E21B 47/06* (2012.01)

(52) U.S. Cl.
CPC ..... *E21B 47/117* (2020.05); *E21B 47/06* (2013.01)

(58) Field of Classification Search
CPC ..... E21B 47/117; E21B 47/06
See application file for complete search history.

(56) References Cited

U.S. PATENT DOCUMENTS 9,528,364 B2 * 12/2016 Samuel ..... E21B 47/006
10,161,239 B2 * 12/2018 Sweatman ..... E21B 33/04
11,073,011 B2 * 7/2021 Haghshenas ..... G01M 3/28
11,125,077 B2 * 9/2021 Lewandowski ..... E21B 47/10
11,401,796 B2 * 8/2022 Mulhim ..... E21B 49/00
11,448,061 B1 * 9/2022 Alghazali ..... E21B 47/117
2009/0159275 A1 * 6/2009 Kannan ..... E21B 49/008 166/250.01
2012/0059521 A1 * 3/2012 Iversen ..... E21B 44/00 700/275

(Continued)

FOREIGN PATENT DOCUMENTS

WO WO-2013169256 A1 * 11/2013 ..... E21B 21/003
WO 2016/022069 A2 2/2016

OTHER PUBLICATIONS

Orszulik, Stefan, "Environmental Technology in the Oil Industry"; Third Edition; pp. v-485; 2016 (485 pages).

*Primary Examiner* — Jennifer H Gay
(74) *Attorney, Agent, or Firm* — Osha Bergman Watanabe & Burton LLP

(57) ABSTRACT

Methods and systems for monitoring an annulus pressure of a well. The method includes performing periodic surveys to monitor an annulus pressure of the well, determining the annulus pressure of the well over a period of time, comparing the annulus pressure to a Maximum Allowable Wellhead Operating Pressure (MAWOP), and generating a decision on whether the well is a workover candidate based on results of the comparison. The system includes a collecting tool that performs periodic surveys to monitor an annulus pressure of the well, determines the annulus pressure of the well over a period of time, and broadcasts information relating to the periodic surveys. The system further includes a processor that obtains the information relating the periodic surveys, compares the annulus pressure to a Maximum Allowable Wellhead Operating Pressure (MAWOP), and generates a decision on whether the well is a workover candidate based on the results of the comparison.

19 Claims, 27 Drawing Sheets

(56) References Cited

U.S. PATENT DOCUMENTS

| | | | | |
|---|---|---|---|---|
| 2014/0214326 | A1* | 7/2014 | Samuel | E21B 47/006 702/11 |
| 2014/0290940 | A1* | 10/2014 | Sweatman | E21B 47/103 166/250.07 |
| 2017/0138170 | A1* | 5/2017 | Vavik | E21B 47/001 |
| 2020/0011169 | A1* | 1/2020 | Haghshenas | G01B 7/10 |
| 2020/0024942 | A1* | 1/2020 | Lolla | G01V 9/005 |
| 2021/0156244 | A1* | 5/2021 | Hoeie | E21B 47/117 |
| 2021/0355808 | A1* | 11/2021 | Volkov | E21B 47/117 |
| 2022/0025757 | A1* | 1/2022 | Mulhim | E21B 47/01 |
| 2022/0282615 | A1* | 9/2022 | Alghazali | E21B 47/06 |
| 2023/0080453 | A1* | 3/2023 | Idris | E21B 47/06 166/250.01 |
| 2023/0228184 | A1* | 7/2023 | Al-Dhafeeri | E21B 47/008 166/250.15 |
| 2023/0228186 | A1* | 7/2023 | Al-Dhafeeri | E21B 49/008 166/91.1 |
| 2023/0272707 | A1* | 8/2023 | Al-Dhafeeri | E21B 34/02 166/250.01 |
| 2023/0323771 | A1* | 10/2023 | Al-Dhafeeri | E21B 49/087 166/250.01 |

* cited by examiner

800

| *NO. WELLS VERSUS AGE* | *NO. WELLS WITH CASING LEAK* |
|---|---|
| 79 WELLS ARE 50+ YEARS OLD | 3 |
| 70 WELLS ARE 40+ YEARS OLD | 5 |
| 22 WELLS ARE 30+ YEARS OLD | 1 |
| 139 WELLS LESS THAN 30 YEARS OLD | 3 |
| TOTAL 310 WELLS | 12 |

FIG. 8

METHOD AND SYSTEM FOR MONITORING AN ANNULUS PRESSURE OF A WELL

BACKGROUND

In a producing well, communication (e.g., leakage of fluids) between casing strings within a well is undesirable. As a producing well ages, the possibility of leakage of fluids increases. The fluid leakage may be attributed to corrosion of tubing, damage to gas lift valves, degradation of cement in the well, leakage of water from an aquifer into the well, or leakage of reservoir fluids. Currently, any measurable amount of sustained casing pressure (SCP) indicated on one or more casing strings of the well (excluding drive pipe and structural casing) is interpreted as a significant alert for well integrity and safety issues. SCP is defined as the pressure which occurs as a result of fluid leakage into an annulus, and which rebuilds after bled-off. SCP is indicative of a failure of one or more barrier elements, which enables communication between a pressure source within the well and an annulus causing casing-casing or tubing-casing leaks. Thus, SCP provides an indication of a loss of integrity in the well, that can lead to an uncontrolled release of fluids, which in turn can lead to unacceptable safety and environmental consequences.

SUMMARY

In one aspect, one or more embodiments relate to a method for monitoring an annulus pressure of a well, comprising: performing periodic surveys to monitor an annulus pressure of the well; determining the annulus pressure of the well over a period of time; comparing the annulus pressure to a Maximum Allowable Wellhead Operating Pressure (MAWOP); and generating a decision on whether the well is a workover candidate well based on results of the comparison.

In one aspect, one or more embodiments relate to a system for monitoring an annulus pressure of a well, the system comprising: a collecting tool that performs periodic surveys to monitor an annulus pressure of the well, determines the annulus pressure of the well over a period of time, and broadcasts information relating to the periodic surveys; and a processor that: obtains the information relating the periodic surveys, compares the annulus pressure to a Maximum Allowable Wellhead Operating Pressure (MAWOP), and generates a decision on whether the well is a workover candidate well based on the results of the comparison.

In one aspect, one or more embodiments relate to a non-transitory computer readable medium storing instructions executable by a computer processor, the instructions including functionality for performing periodic surveys to monitor an annulus pressure of the well; determining the annulus pressure over a period of time; comparing the annulus pressure to a Maximum Allowable Wellhead Operating Pressure (MAWOP); performing a bleed-down test and a pressure build-up test when the annulus pressure is greater than 100 psi but less than the MAWOP; evaluating results of the bleed-down test and the pressure build-up test; identifying that the well does not require a remedial action or a workover; generating a decision on whether the well is a workover candidate well based on the results of the comparison and based on the results of the bleed-down test and the pressure build-up test; and performing the remedial action or the workover when the decision indicates that the well is the workover candidate well.

Other aspects of the disclosure will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

FIG. 8 shows a table including a number of wells with a certain age and a number of wells with casing leaks per age in accordance with one or more embodiments.

DETAILED DESCRIPTION

Figure 1:
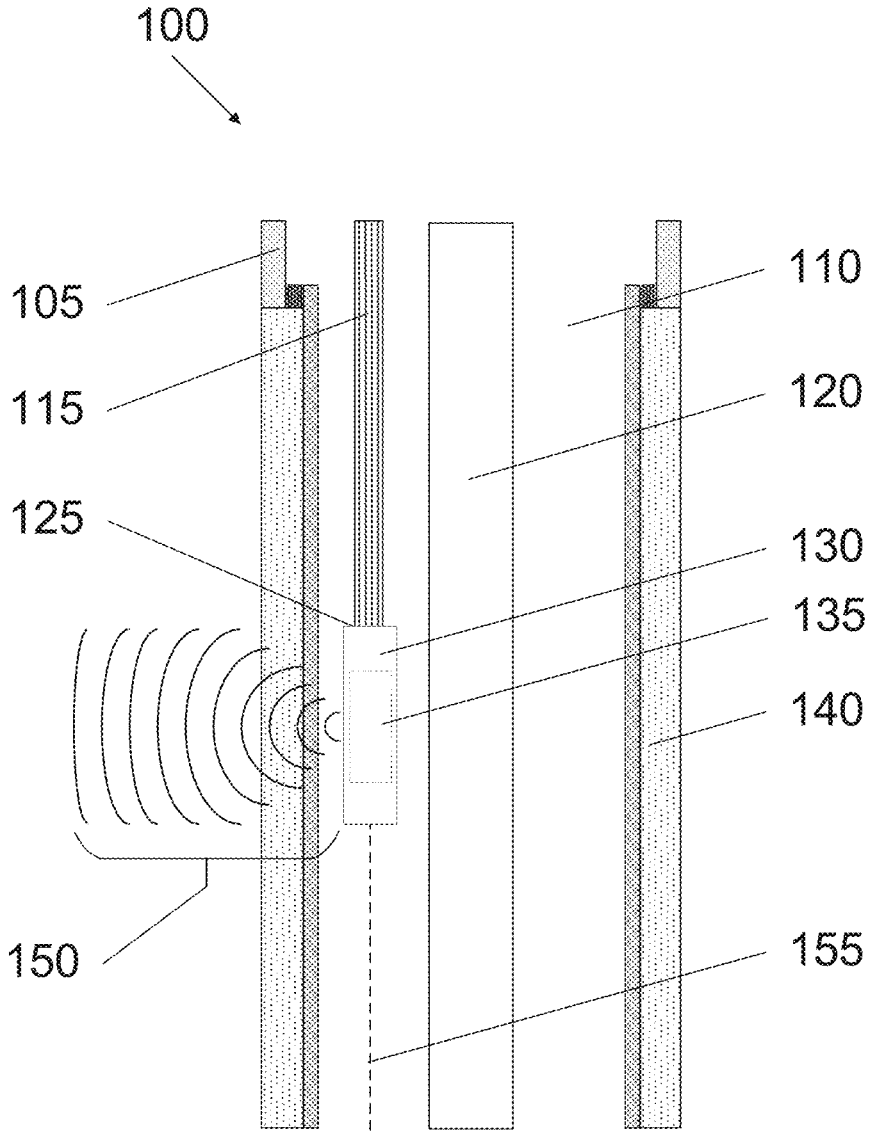
FIG. 1 shows a schematic diagram showing a cross-section view of a system in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include a method and a system for effectively identifying hydrocarbon (i.e., oil and gas) wells which exhibit integrity and safety problems, and which should be recommended for remedial action. In a producing well, the remedial action may be required when communication (e.g., leakage of fluids) found between casing strings within a well is undesirable. The method and the system focus on wells of different ages. As a producing well ages, the possibility of leakage of fluids increases. In this regard, the method and the system disclosed herein evaluate fluid leakage in an annulus of a well, which may be attributed to corrosion of tubing, damage to gas lift valves, degradation of cement in the well, leakage of water from an aquifer into the well, or leakage of reservoir fluids. In the method and the system, any measurable amount of sustained casing pressure (SCP) indicated on one or more casing strings of the well (excluding drive pipe and structural casing) is interpreted as a significant alert for well integrity and safety issues. SCP is defined as the pressure which occurs as a result of fluid leakage into an annulus, and which rebuilds after bled-off. In one or more embodiments, SCP is indicative of a failure of one or more barrier elements, which enables communication between a pressure source within the well and an annulus causing casing-casing or tubing-casing leaks. Thus, the method and the system use SCP to provide an indication of a loss of integrity in the well, that can lead to an uncontrolled release of fluids, which in turn can lead to unacceptable safety and environmental consequences.

In one or more embodiments, downhole temperature surveys are obtained as part of well integrity and safety campaigns in offshore fields to record temperature values measured with respect to depth steps (e.g., logs) in a well. The downhole condition for each well is an essential factor to determine the well status and to prevent a serious reservoir damage if there is cross-flow phenomena. In one or more embodiments, temperatures measurement at various depths are used to establish a temperature profile which reflects the downhole condition. Several oil wells are subject to be evaluated through the campaigns in terms of downhole integrity, such as casing leaks problems. However, due to long period of shutdown for the field, close monitoring surveys with more focus on the aged wells are required to avoid flow behind pipe and the cross-flow phenomena, which leads to the formation damage and production losses.

Advantageously, in one or more embodiments, the method and the system disclosed herein identify the sustained casing pressure (SCP) problems for offshore/onshore hydrocarbon wells during well operational phases in a cost-effective manner. The method and the system reduce downtime at the well by providing testing and analysis of the annulus without requiring downhole intervention to identify SCP. That is, the method and the system do not require interrupting hydrocarbon production, and this allows the method and the system to be implemented as a primary step prior to performing any rig interventions. To this end, the method and the system to identify candidate wells and report the same to operators as wells containing safety issues.

In one or more embodiments, the method and the system identify for a proper time for a well with SCP issues to be candidate as a workover. In some embodiments, the method and the system illustrate action plans for each phase related to SCP problems encountered with offshore/onshore hydrocarbon wells. Advantageously, the method and the system provide a commercially available alternative to identify the hydrocarbon wells with SCP and to determine candidate wells that require workover procedures. For example, the method and the system provides a more cost-effective approach when compared to slickline techniques that interrupt hydrocarbon production such as Bottom Hole Pressure/Temperature surveys (i.e., recording pressure and temperature changes with respect to time) that are used to identify a change on well profiles in terms of anomalies across the well depth. Furthermore, Bottom Hole Pressure/Temperature surveys and other existing techniques, such as identifying a metal loss within the casing using corrosion logging through the wireline operation, cannot be used as a direct problem identification for SCP problems related to hydrocarbon wells.

In some embodiments, the method and the system implement an effectiveness Well Integrity Management (WIM) program. WIM is essential to be implemented over a well life cycle through consideration on available tools in order to maintain the operability of hydrocarbon wells at a healthy and a safe manner. WIM programs contribute on preventing issues related to well safety and integrity, which improves the operation practices associated with production losses and well downtime.

FIG. 1 shows a schematic diagram illustrating a collecting tool 130 used for monitoring an annulus pressure in an area of interest of a well. The collecting tool 130 performs periodic surveys to monitor a pressure of an annulus 110 in a wellbore 140. The collecting tool 130 includes a central chamber 135 configured to generate signals 150 against the inside of the annulus 110 and to collect reflections of these signals as the signals bounce against a casing 105 and a tubing 120 of the wellbore 140. The collecting tool 130 may have a cylindrical housing that extends through an entire length of the collecting tool 130 along a central axis 155. The collecting tool 130 may be lowered and raised along an underground sediment section to perform the periodic surveys. The collecting tool 130 may be lowered to a depth below using a conveyance mechanism 115. In some embodiments, the collecting tool 130 includes a top portion 125 operably connected to the conveyance mechanism 115 that lowers and rises the collecting tool 130 along the wellbore 140.

In some embodiments, the collecting tool 130 may exchange information with a well control system 350 (i.e., surface panel). In some embodiments, the collecting tool 130 may include sensors and systems for collecting data relating to the area of interest. In some embodiments, the collecting tool 130 may include hardware and/or software for creating a secure wireless connection (i.e., a communication link) with the surface panel to insure real-time data exchanges and compliance with data protection requirements.

The logging tool 130 may be lowered and raised along the wellbore 140 to sample physical phenomena inside the wellbore 140 and/or outside the casing 105 of the wellbore 140. In this regard, certain phenomena may require specialized equipment (i.e., devices including sensitive or radioactive materials) to be lowered for sampling one or more formation characteristics. In some embodiments, the logging tool 130 may exchange information with a surface panel while avoiding the need to bring a rig to a well location to install tubing equipped with permanent downhole monitoring systems or thru-tubing retrievable intelligent completion systems. Such systems normally require removal for intervention jobs. A well intervention is any operation carried out on a hydrocarbon (i.e., oil and gas) well during or at the end of the production life of the well. Well intervention may function to alter the state of the hydrocarbon well and/or well geometry for providing well diagnostics or management of the production of the well. Well intervention jobs include, for example, pumping jobs, maintenance jobs, slickline jobs, coiled tubing jobs, perforation jobs, and workover jobs. An example of well intervention is when a logging tool/device is stuck in the wellbore 140.

Figure 2:
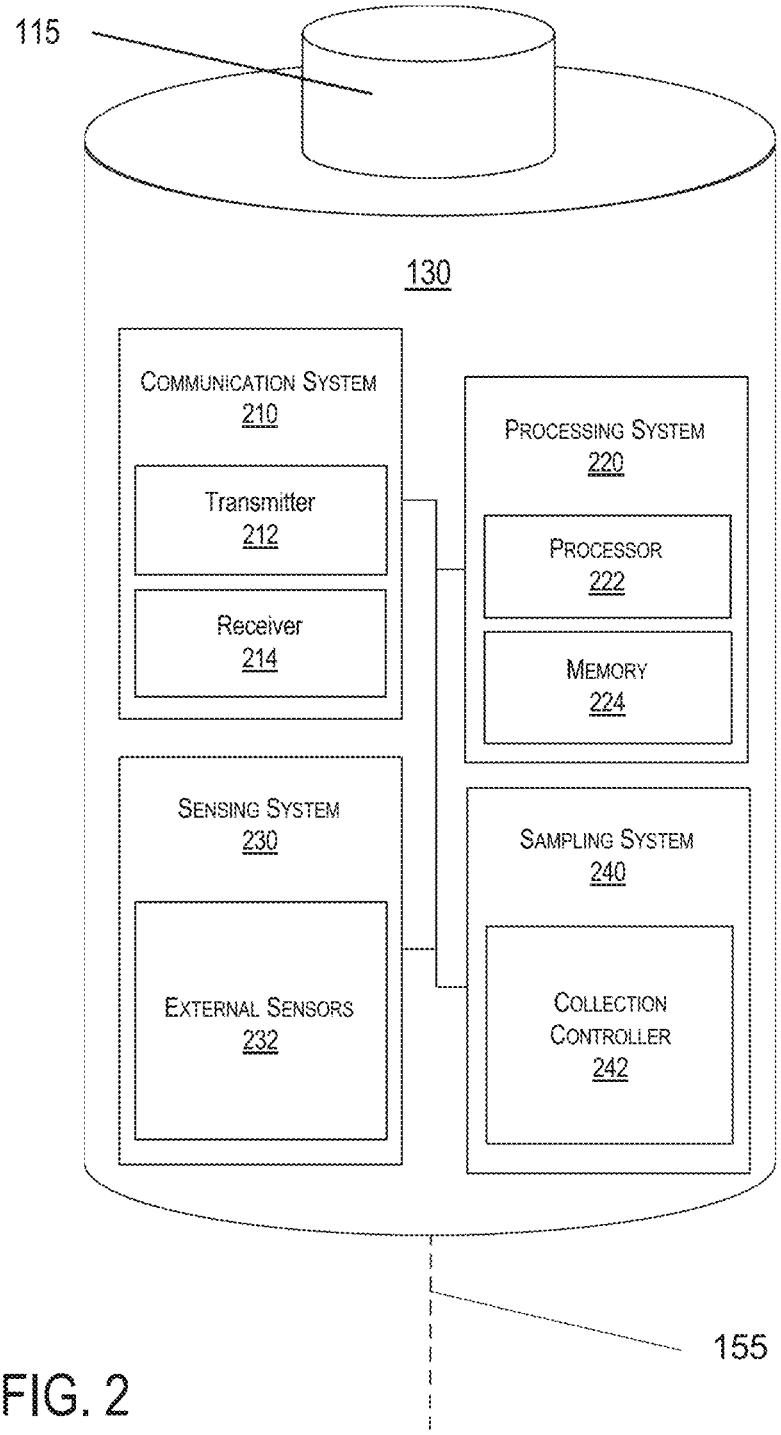
FIG. 2 shows a schematic diagram of an evaluation device in accordance with one or more embodiments.

FIG. 2 shows an expanded view of the colleting tool 130. The schematic diagram of FIG. 2 shows various components that may be incorporated into the collecting tool 130. In some embodiments, the collecting tool 130 includes electronic components that enable the collecting tool 130 to perform communication functions, data collecting functions, and/or processing functions. In some embodiments, the collecting tool 130 includes a communication system 210, a processing system 220, a sensing system 230, and a sampling system 240 coupled to the central chamber 135. The communication system 210 may include communication devices such as a transmitter 212 and a receiver 214. The transmitter 212 and the receiver 214 may transmit and receive communication signals, respectively. Specifically, the transmitter 212 and the receiver 214 may communicate with one or more control systems located at a remote location through a wired connection. In some embodiments, the communication system 210 may communicate wirelessly with the control system 350 shown in FIG. 3.

The processing system 220 may include a processor 222 and a memory 224. The processor 222 may perform computational processes simultaneously and/or sequentially. The processor 222 may determine information to be transmitted and processes to be performed using information received or collected. Similarly, the processor 222 may control collection and exchange of geospatial information from the collecting tool 130.

The sensing system 230 may include external sensors 232. The external sensors 232 may be sensors that collect physical data from the environment surrounding the collecting tool 130. The external sensors 232 may be lightweight sensors requiring a small footprint. These sensors may exchange information with each other and supply it to the processor 222 for analysis. The external sensors 232 may be logging tools of an electrical type, a nuclear type, a sonic type, or another type. The external sensors 232 may release signals (i.e., electrical, nuclear, or sonic) through a signal generator at a sensing portion.

The sampling system 240 may include a collection controller 242 that coordinates collection of the annulus pressure, performing of bleed-down tests, and performing build-up tests.

Figure 3:
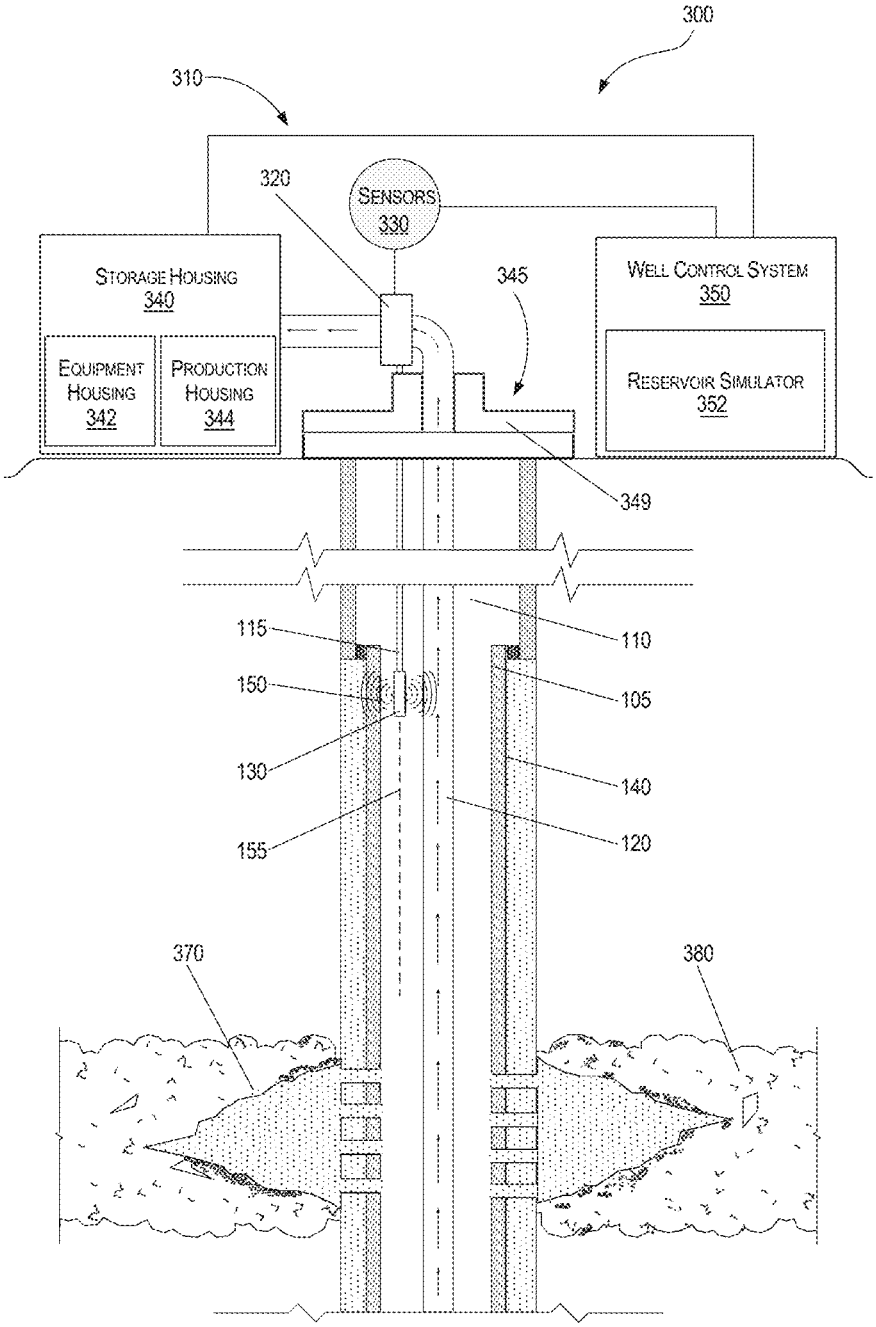
FIG. 3 shows a system in accordance with one or more embodiments.

FIG. 3 shows an example of the collecting tool 130 being used in a collection system 300 for monitoring an annulus pressure of the well 310 in accordance with one or more embodiments. The collection system 300 may include a storage housing 340 including an equipment housing 342 and a production housing 344. The collection system 300 may include surface equipment 310 including the well control system 350 containing a reservoir simulator 352 in constant communication with sensors 330. The sensors 330 may be connected to a production flow valve 320 configured to regulate production flow through a wellhead 349.

The collection system 300 may include the well control system 350. In some embodiments, during operation of the collection system 300, the well control system 350 may collect and record wellhead data for the collection system 300. In some embodiments, the well control system 350 may regulate the movement of the conveyance mechanism 115 by modifying the power supplied to multiple actuating devices. The conveyance mechanism 115 may be a tool coupling the collecting tool 130 to the surface equipment 310. In some embodiments, the control system 350 includes the surface panel described in reference to FIG. 1.

The control system 350 may include a laboratory equipment room (not shown). The laboratory equipment room may include hardware and/or software with functionality for generating one or more basin models regarding a formation 380 and/or performing one or more reservoir simulations. The laboratory equipment room may be used for performing experiments relating to identifying a pressure or a temperature above an underground sediment section 370. Further, the laboratory equipment room may include a memory device for storing formation logs and data regarding source rock samples for performing modeling or simulations. While the laboratory equipment room may be coupled to the well control system 350, the laboratory equipment room may be located away from the rig site. In some embodiments, the laboratory equipment room may include a computer system disposed to analyze tests performed by the collecting tool 130 at any given time. The laboratory equipment room may use the memory for compiling and storing historical data about the underground sediment section 370.

In some embodiments, the production flow valve 320 may include actuating devices including motors or pumps connected to the conveyance mechanism 115 and the well control system 350. In some embodiments, the measurements performed by the collecting tool 130 are recorded in real-time, and are available for review or use within seconds, minutes or hours of the condition being sensed (e.g., the measurements are available within 1 hour of the condition being sensed). In such an embodiment, the wellhead data may be referred to as "real-time" wellhead data. Real-time data may enable an operator of the collection system 300 to assess a relatively current state of the collection system 300 and make real-time decisions regarding development of the collection system 300 and the reservoir.

The well control system 350 may be coupled to the sensors 330 to sense characteristics of substances in storage housing 340, including production, passing through or otherwise located in the collection system 300. The characteristics may include, for example, pressure, temperature, and flow rate of production flowing through the wellhead 345, or other conduits of the well control system 350, after exiting the wellbore 140.

The sensors 330 may include a surface pressure sensor operable to sense the pressure of production flowing to the well control system 350, after it exits the wellbore 150. The sensors 330 may include a surface temperature sensor including, for example, a wellhead temperature sensor that senses a temperature of production flowing through or otherwise located in the wellhead, referred to as the "wellhead temperature" (Twh). In some embodiments, the sensors 330 include a flow rate sensor operable to sense the flow rate of production flowing through the well control system 350, after it exits the wellbore 140. The flow rate sensor may include hardware that senses the flow rate of production (Qwh) passing through the wellhead.

The well control system 350 includes a reservoir simulator 352. For example, the reservoir simulator 352 may include hardware and/or software with functionality for generating one or more reservoir models regarding the signals 150 and/or performing one or more reservoir simulations. For example, the reservoir simulator 352 may perform processing of results from comparisons and tests performed by the collecting tool 130 and the well control system 350. Further, the reservoir simulator 352 may store well logs and data regarding core samples for performing simulations. While the reservoir simulator 352 is shown at a well site, embodiments are contemplated where reservoir simulators are located away from well sites.

Figure 4:
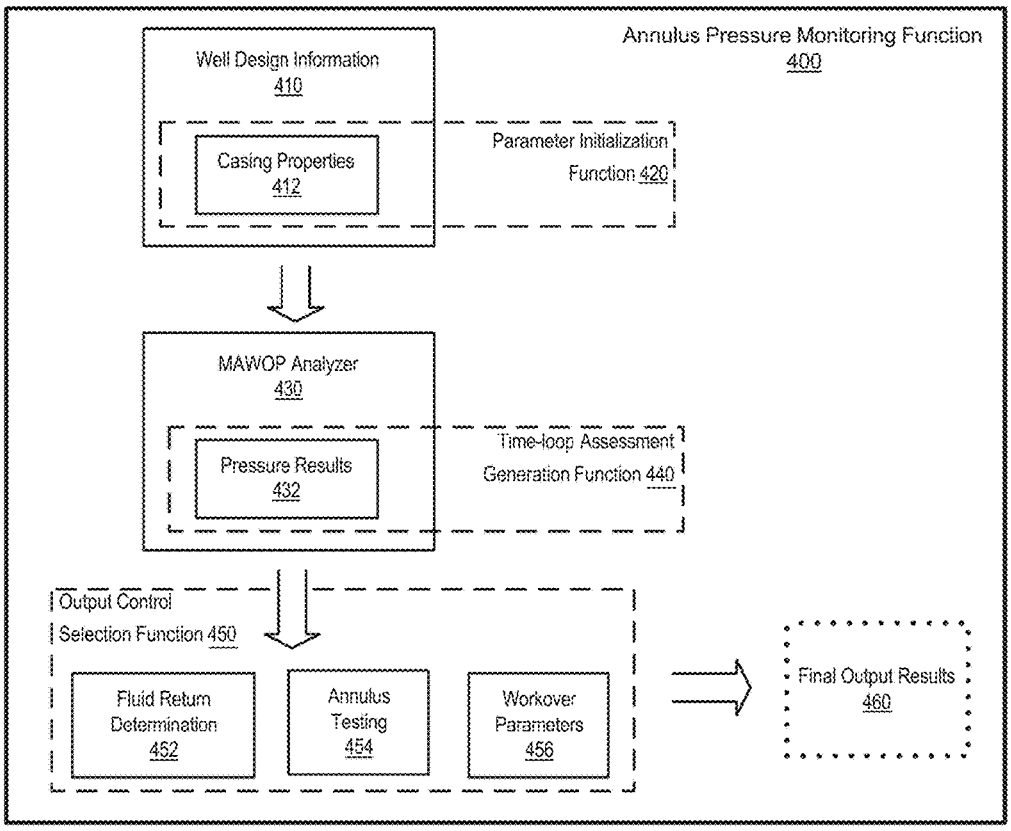
FIG. 4 shows an annulus pressure monitoring function in accordance with one or more embodiments.

FIG. 4 illustrates a successive flow of parameters implemented in monitoring an annulus pressure of a well by an annulus pressure monitoring function 400. The annulus pressure monitoring function may be hardware and/or software configured to monitor the pressure in the annulus of the hydrocarbon well. In FIG. 4, the annulus pressure monitoring function 400 may be implemented by one or more devices described in reference to numeral 130 of FIG. 1, in reference to the collection system 300 of FIG. 2, or in reference to the computer system 1400 of FIG. 14. In some embodiments, the annulus pressure monitoring function 400 identifies well design information 410 (i.e., swell construction information) including casing properties 412 for using in a parameter initialization function 420 of an area of interest. The area of interest is any casing portion or section of a wellbore in which communication may be identified. In some embodiments, the method and the system perform periodic surveys to monitor an annulus pressure of the well in the area of interest.

In the parameter initialization function 420, the parameters associated with the well design information 410 are selected based on their relevance. The parameter initialization function 420 may share processing with a time-loop assessment generation function 440, which controls a Maximum Allowable Wellhead Operating Pressure (MAWOP) analyzer 430 indicating a pressure result 432 in which an iterative loop determines a number of required pressure results. The iterative loop is a representation of the repetitive process of evaluating subsequent parameters based on the periodic surveys on the annulus until a final time of the iterations is reached. The final time may be controlled by hardware or software of the annulus pressure monitoring function 400.

Once the MAWOP analyzer 430 processes the pressure results 432, an output control selection function 450 may perform processing of the initialized parameters to perform fluid return determination 452, perform annulus testing 454, and update workover parameters 458. As a result, final output results 460 may be obtained for instructing the implementation of remedial actions or workover operations. To this end, the annulus pressure monitoring function 400 may provide the possibility to generate decisions as to whether a well is a workover candidate well based on the results of the performed fluid return determination 452, the performed annulus testing 454, and the updates workover parameters 458.

Figure 5:
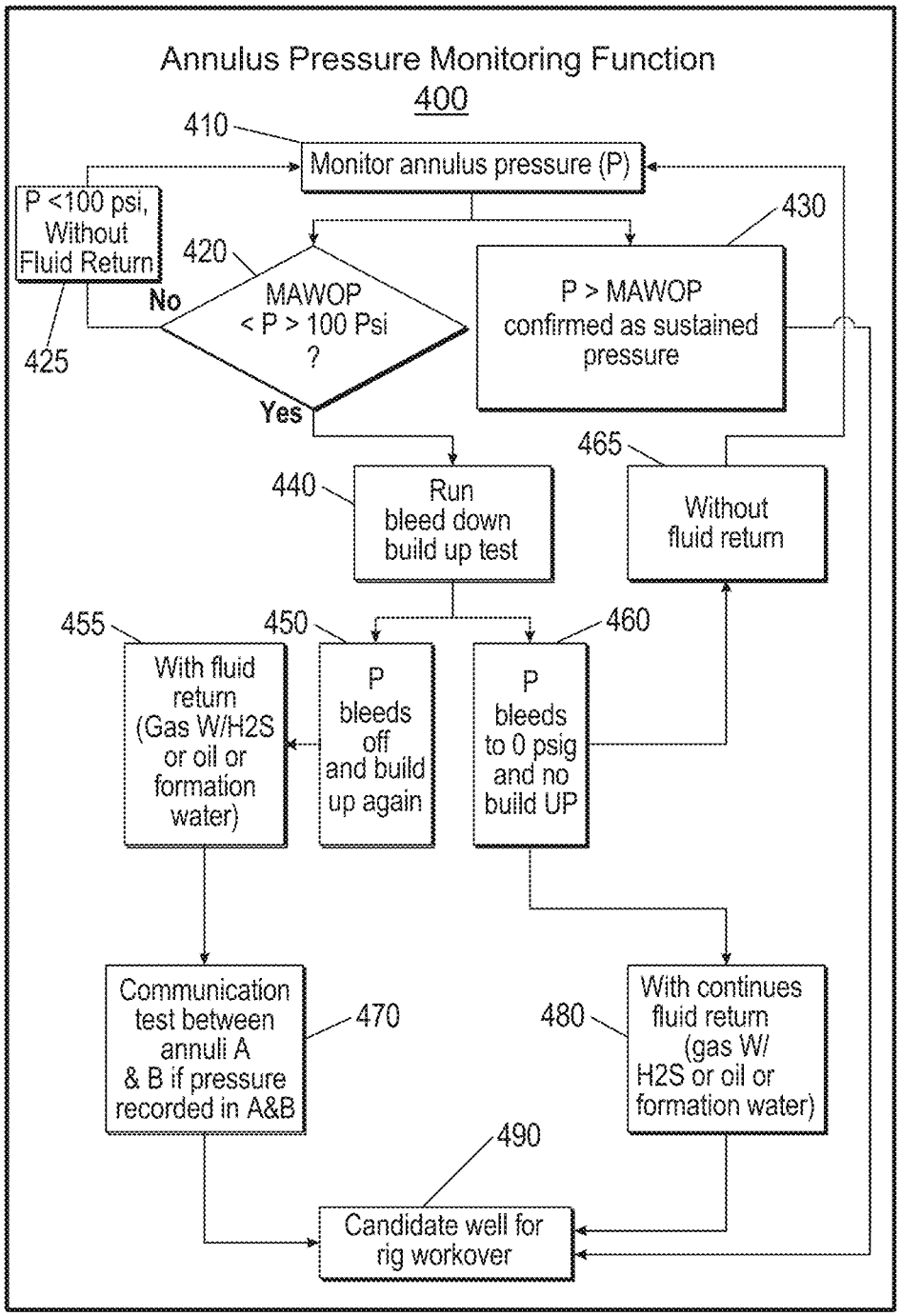
FIG. 5 shows an annulus pressure monitoring function in accordance with one or more embodiments.

FIG. 5 illustrates a successive flow of parameters implemented in monitoring an annulus pressure of a well by the annulus pressure monitoring function 400. FIG. 5 expands on the functions of the MAWOP analyzer 430 and the output control selection function 450 from FIG. 4. In one or more embodiments, the method identifies and selects workover candidate wells. Workover candidate wells are wells that are identified as having sustained casing pressure for offshore/onshore hydrocarbon wells during well operational phases and a shutdown condition. The method effectively identifies the SCP for hydrocarbon wells which have suffered from integrity and safety issues. In some embodiments, the annulus pressure monitoring function 400 generates the decision that recommends a proper workover plan with the best remedial action programs.

The annulus pressure monitoring function 400 alerts operators to decide a proper mitigation plan when communication is identified. In some embodiments, the annulus pressure monitoring function 400 is used as a tool to develop a strategy for upcoming workover programs. According to one or more embodiments, providing alerts for proper mitigation plans without required sustained downtime for the well, maintains well integrity and safety, maintains well productivity, maximizes well operation life, identifies SCP problems, resolves any uncertainty related to well integrity conditions, provides a cost-effective approach without downhole intervention, prevents oil spill and environment impact, prevents risks related to well blowout and assets damage, prevents underground fluid invasion into water aquifer, avoids downhole cross flow between multi-oil bearing reservoir, prevents formation damage due to dumping water into oil bearing reservoirs, and minimizes hydrocarbon leaks that may jeopardize a production platform.

As shown in Block 410 of FIG. 5, the annulus pressure monitoring function 400 starts by carrying out periodic surveys and well head maintenance campaigns to monitor an annulus pressure (P) of the hydrocarbon well. The annulus pressure monitoring function 400 determines the annulus pressure over a period of time and compares the annulus pressure to predetermined MAWOP. As shown in Blocks 420 and 425, if the annulus pressure is more than 100 psi and less than the MAWOP and without fluid return, then the annulus pressure monitoring function 400 keeps monitoring the annulus pressure of the hydrocarbon well over another period of time. As shown in Block 430, if the annulus pressure is greater than the MAWOP on the hydrocarbon well and the hydrocarbon well is confirmed to undergo a sustained pressure, the annulus pressure monitoring function 400 immediately labels the hydrocarbon well as a candidate well for workover.

In Block 440, if the annulus pressure is more than 100 psi and less than the MAWOP and there is a fluid return, the hydrocarbon well is further evaluated for leakage as the fluid return may indicate that there is SCP in the hydrocarbon well. In this case, the annulus pressure monitoring function 400 instructs the collecting tool 130 to perform bleed-down tests and build-up tests on the hydrocarbon well. During the bleed-down tests and the build-up tests, the annulus pressure monitoring function 400 evaluates results from the tests to determine whether the hydrocarbon well should be labeled the hydrocarbon well as a candidate well for workover or whether the annulus pressure of the hydrocarbon well over another period of time.

Upon obtaining the test results, in Blocks 460 and 465, if the casing pressure bleed down to 0 psi and there is no pressure build up observed and without fluid return, then the annulus pressure monitoring function 400 keeps monitoring the annulus pressure of the hydrocarbon well over another period of time. In Blocks 450 and 455, if the casing pressure bleeds down to 0 psi and there is no pressure build up observed and with continued fluid return with formation water or oil bearing reservoirs and/or gas with H2S, fluid samples should be collected for lab analysis in order to identify the fluid source. In Block 470, if the casing pressure bleed down to 0 psi and there is pressure build up observed along with a fluid return then fluid samples should be collected for lab analysis in order to identify whether the fluid source is from a formation water or an oil bearing reservoir. In Block 490, the annulus pressure monitoring function 400 labels the hydrocarbon well as the workover candidate well under the last two conditions and selects the hydrocarbon well as a workover candidate.

In case of various casing pressures presenting various hydrocarbon wells, the annulus pressure monitoring function 400 performs communication tests between annulus casings to identify the source of casing pressures continuously until one of the hydrocarbon wells is labeled as a candidate well for rig workover, as shown in Block 490.

Figure 6:
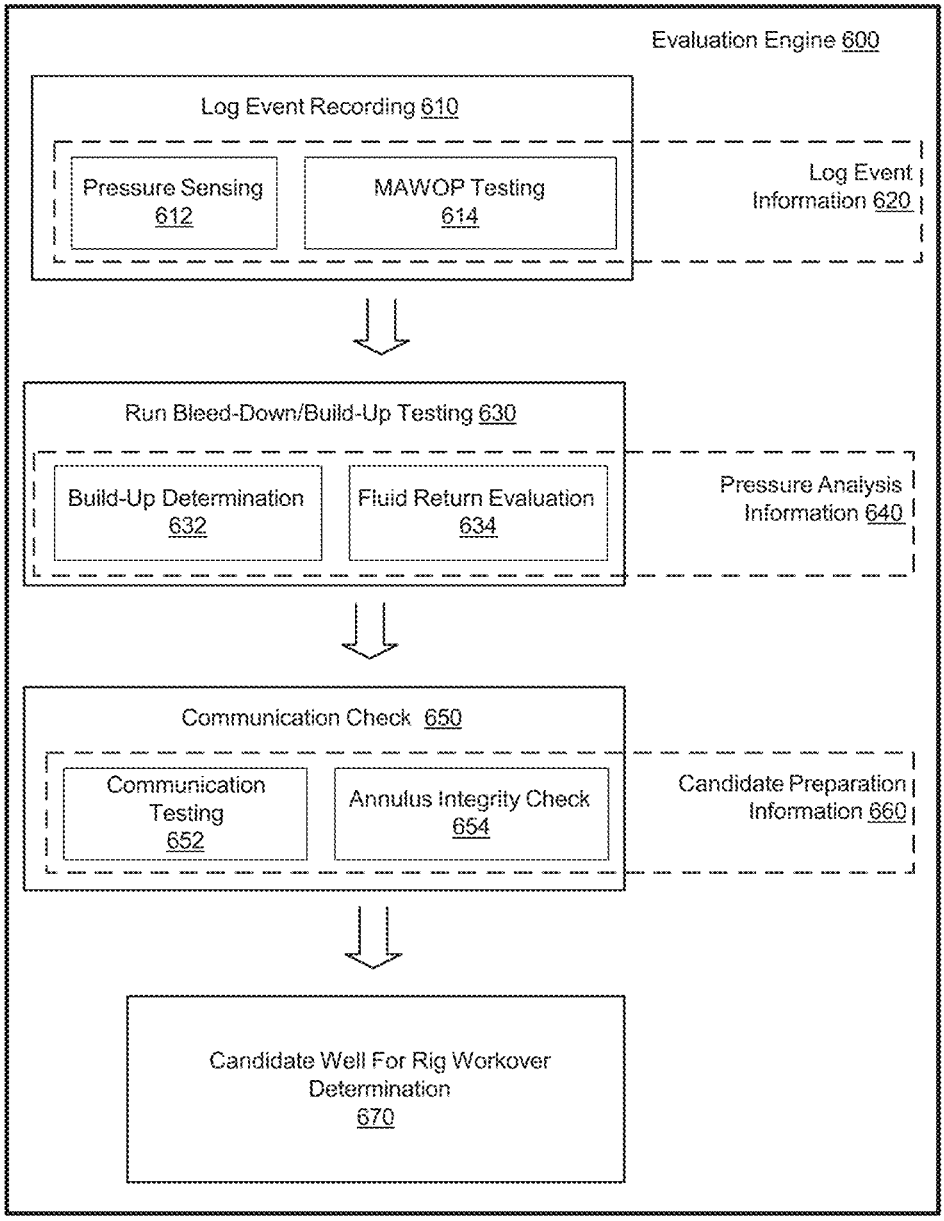
FIG. 6 shows an evaluation engine in accordance with one or more embodiments.

FIG. 6 shows an example schematic diagram in accordance with one or more embodiments. In one or more embodiments, the method and the system include an evaluation engine 600 for monitoring the annulus pressure of a well. The method and the system may analyze measured results and tests while providing a quick assessment on whether the well should be considered for a remedial action or a workover.

In some embodiments, the evaluation engine 600 starts or continues a log event recording 610 that combines pressure sensing 612 and MAWOP testing that uses existing and constantly updating log event information 620. At this stage, previous MAWOP testing is used to update the log event information 620 as obtained from the annulus pressure monitoring function 400. The log event information 620 effectively constructs and updates one or more databases including annular pressure information and pressure results. The log event information 620 is updated and validated before the evaluation engine 600 uses log event information 620.

Once the log event information 620 is updated and validated, the evaluation engine 600 runs bleed-down/build-up testing 630 to perform a build-up determination 632 and a fluid return evaluation 634. In some embodiments, the build-up determination 632 and the fluid return evaluation 634 are performed as a result of the bleed-down/build-up testing 630 to obtain pressure analysis information 640. The pressure analysis information 640 is information associated with the results of the bleed-down tests and the build-up tests performed by the annulus pressure monitoring function 400.

Once the bleed-down/build-up testing 630 is performed and the corresponding results are stored in the one or more databases, the evaluation engine 600 implements a communication check 650 including communication testing 652 and an annulus integrity check 654. The communication check 650 has the goal of preparing information obtained by the evaluation engine 600 into a decision report to list the well for further monitoring or for further candidacy for a well. The decision report is included in a candidate preparation information 660 that includes a determination on whether the well is the workover candidate well over the period of time. As noted above, the evaluation engine 600 identifies that the workover candidate well over the period of time is a candidate well for rig workover determination 670 requires the remedial action or the workover.

Remedial actions and workovers are implemented to solve casing leaks. Casing leaks are generally related to significant corrosion in wells with poor cement placement across shallow formation contained a corrosive fluid. Casing leak repair selections are different, and it could be costly based on the well type, casing size and condition of the well, and an interval depth and leak path. The offered options for repair though well workover operation may be included in a cement-squeezing job, casing liner/patch, and a chemical treatment job. In case of a well with a failure to fix casing leaks, the well may be a candidate for a suspension or an abandonment. Casing leaks may lead to losing a well integrity and consequently the well productivity. Moreover, the well may develop serious risks to people's safety and the environment. Leak detection diagnoses in terms of fluid type, source/location, and rate/size, may affect the selections of corrective remedial action prior to the well workover operation. As such, problem identification with the evaluation engine 600 in the manner described above is essential to have better understanding on which methodology to be utilized in a cost-effective manner.

Figure 7:
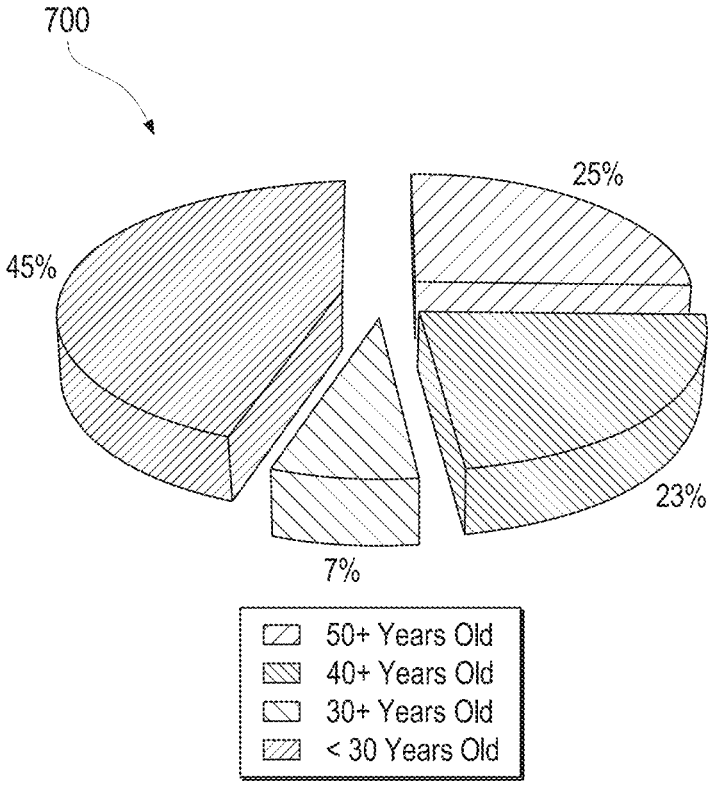
FIG. 7 shows a chart including percentages of damaged wells based on their age in accordance with one or more embodiments.

FIGS. 7 and 8 show a summary of data collected from wells sampled for casing leakage. The results of the data collected indicate a strong correlation between the age of the wells and leakage in the well. More specifically, the data shows that older wells are more likely to have casing leakage than newer wells. As shown in FIG. 7, a graph 700 shows that wells that were exclusively 50 years old or older were 25% of the wells sampled, wells that were exclusively 40 years old or older were 23% of the wells sampled, wells that were exclusively 30 years old or older were 7% of the wells sampled, and wells that were 30 years old or younger were 45% of the wells sampled. As shown in FIG. 8, a table 800 of FIG. 8 illustrates that 3 wells out of 79 wells that are exclusively 50 years old or older did not show casing leaks, 5 wells out of 70 wells that are exclusively 40 years old or older did not show casing leaks, 1 well out of 22 wells that are exclusively 30 years old or older did not show casing leaks, and 3 wells out of 139 wells that are exclusively 30 years old or younger did not show casing leaks. Thus, out of 310 wells samples, 12 wells were identified to have casing leaks.

The wells sampled were mostly younger wells such that a clear distinction may be identified if age was a factor in casing leakage. These wells were completed with conventional drilling practices. The casings design criteria were based on two overlapped strings of 18-⅝ and 13-⅜ inches sizes of carbon steel alloy across aquifer and cemented barriers. Based on the cement evaluation for cement distribution quality between the aquifer and downward to the top of some reservoirs, it was revealed that a poor cement bond led to a loss of zonal isolation and a well barrier failure. These findings allowed the water to be channeled behind the casing from a shallow aquifer into the reservoir. In addition, a serious corrosion effects on 9-⅝ inches casing across shallow aquifer was confirmed and observed on other wells which resulted in a sever corrosion rate on 7 inches casing (e.g., production casing) with a casing leak.

Figure 9:
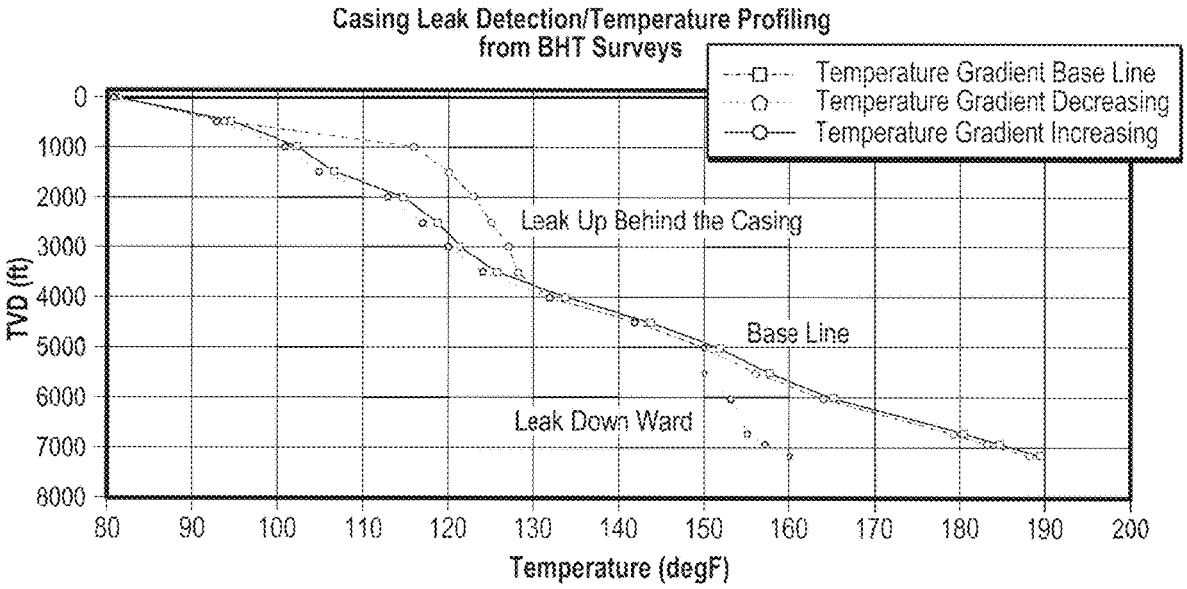
FIG. 9 shows a graph including a temperature gradient and casing leak detection plot in accordance with one or more embodiments.

FIG. 9 shows a cross-plot of casing leak detection/temperature profiling for Bottom Hole Temperature (BHT) surveys. In completion procedures, a well is cemented to a required depth. Common in the art, the location of the cement top may be disposed behind each casing. The cement is disposed behind each casing because produced cement releases heat over a period of time. As shown in FIG. 9, temperature logging may be utilized to confirm that a well was cemented to the required depth. This behavior may be determined when a geothermal gradient base line is created compared to the true vertical depth (TVD), which is measured in ft. The temperature log, which is measured in degrees Fahrenheit, may be run while the cement is on a setting process, which it is expected the temperature anomaly decreases with time. As shown in FIG. 9, casing leak detection may be monitored using temperature profiles that continuously track geothermal gradient deviation from the geothermal base line (i.e., increasing or decreasing). A temperature profile is one of the main diagnostics tools to provide potential casing leak locations if it is integrated with other surface parameters. As such, an increase above the geothermal temperature gradient base line may be detected that there is leak up behind the casing, and a decrease below the geothermal gradient base line may be detected leak downward.

In an applied time-lapse (i.e., over a period of time) and using the technique for temperature gradient of Bottom Hole Pressure Temperature (BHPT) surveys to identify temperature anomaly, it may be observed that the wells suffered from a casing leak and a cross flow phenomena due to a shallow aquifer (formation with corrosive water bearing). In this case, the well may be recommended to be a candidate for workover operation to fix and restore the well integrity.

As shown in FIG. 9, a temperature profile along well borehole depths is crucial in terms of well integrity assessment. In addition, it can be of value utilizing the temperature measurement in order to correct well logging (i.e., resistivity) which is sensitive to the temperature profile. A BHPT survey with downhole parameters measurements may be utilized to evaluate the well productivity and water movement. The temperature increases with depth, and this is linked to the geothermal gradient in terms of the rate of temperature with respect to the borehole depth. In some cases, the homogenous formations with temperature gradient may be a function directly to vary depths based on geographical location and the thermal conductivity of the formation. Plotting temperature profiles as a time-lapse technique with interpretation of temperature gradient changes may be utilized by the annulus pressure monitoring function 400 and the evaluation engine 600 to determine the fluid movement and/or fluid entry location. As such, a corrective action of well integrity management may be implemented.

Figure 10:
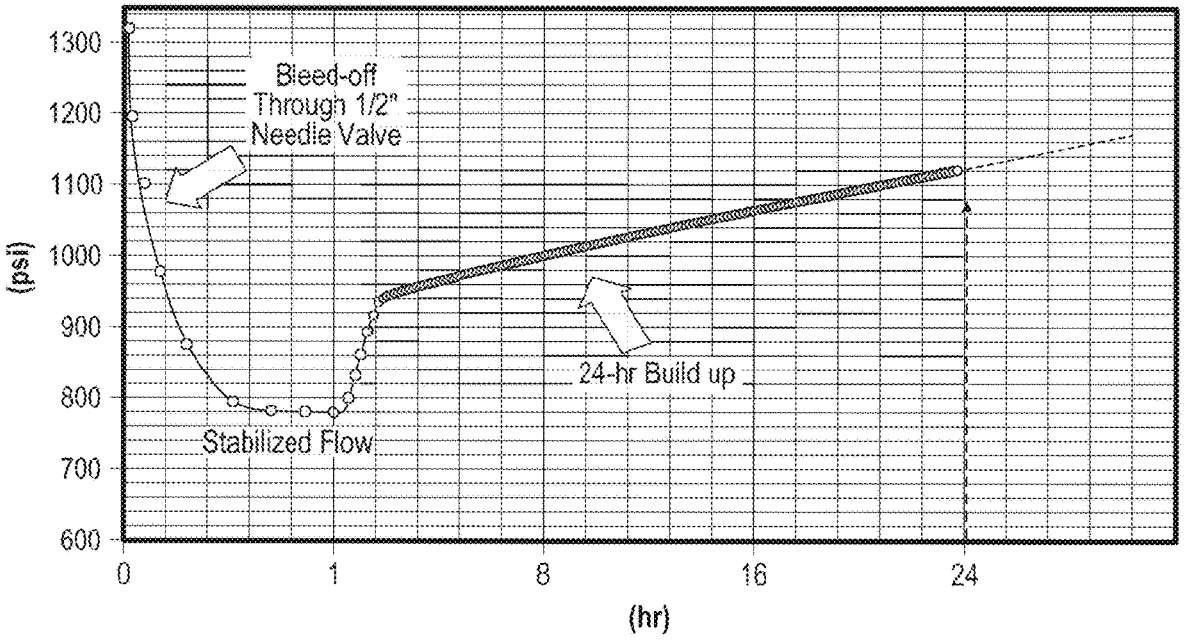
FIG. 10 shows a graph including a trend of bleed-down/build-up in accordance with one or more embodiments.

FIG. 10 shows a graph illustrating a trend of bleed-down/build-up test for an offshore well. The graph contrasts pressure changes, measured in psi, against time, measured in hours. In some embodiments casing leak detection tools may include the collecting tool 130. In some embodiments, the annulus pressure monitoring function 400 and the evaluation engine 600 may integrate the findings related to the WIM data acquisition program including surface/downhole parameters to define the wells with safety and integrity issues, such as a SCP, a casing leak, and well completion accessories failures. There are several tools and techniques at surface and/or downhole condition which the annulus pressure monitoring function 400 and the evaluation engine 600 may be utilized to assist in identifying the casing condition. These tools may vary in methodologies, and they may be costly to implement.

In some embodiments, a well performance review is an important tool to evaluate well integrity and operability condition. The well performance review may be done through a frequent measuring with a close monitoring of the well on surface parameters such as wellhead flowing pressures & temperatures, BS&W, and production testing data in the manner described in reference to FIGS. 1-3. In addition, the artificial lift wells performance monitoring may be implemented by controlling the volume of gas injection rate and the casing head pressure for gas lift (GL) wells. For ESP wells, the amp charts for electrical submersible pump (ESP) wells should be considered. Abnormal features and/or dramatic changes for surface parameters trends may be used and combined with other tools to show well problems such as unexpected increase of water cut trend, which are related to either reservoir or well integrity issues.

As part of WIM, casings annulus pressures are monitored frequently by the annulus pressure monitoring function 400 and the evaluation engine 600 through semi-annually basis through annuli pressure survey. As shown in FIG. 10, plotting a pressure trend versus time in combination with other tools to detect the presence of annulus pressure at a wellhead surface. In particular, a Sustained Annulus Pressure (SAP) is considered the most common and critical type of annulus pressure which may be an indication of a failure of one or more barrier elements. SAP can also prove a communication between a pressure source within the well and an annulus. In order to detect a casing leak, the annulus may have a positive pressure with continuous fluid flow return when it is bled-off as part of wellhead integrity monitoring.

During the communication and the bleed-down/build-up tests, communication and pressure bleed-down/build-up tests are applied by the annulus pressure monitoring function 400 and the evaluation engine 600 if the recorded casing annulus pressure is positive. The main objective of these tests is to confirm the presence of build-up pressure at the wellhead sections by bleeding it down to zero to ensure the sustainability of casing pressure in terms of returned fluid rate and pressure build-up values. The bleed-down test should be performed safely through a ½ inch needle valve. A collected sample from fluid return may be analyzed in order to identify the source of leaks in terms of interval depth and fluid properties. As shown in FIG. 10, the communication test may be conducted between production tubing and production casing to confirm the change with pressure behaviors, which it might be connected with other casings at a wellhead.

Fluid sample analysis and laboratory analysis results of collected fluid samples help to understand and to distinguish between reservoir formation water and shallow aquifer water in terms of water salinity. In order to detect the source of leaks either from deeper formations or from shallow aquifer, each formation comprise linked with fluid properties can be used to identify the source in terms of location and interval depth. Therefore, geochemical water analysis of the produced water utilized for identifying the occurrence of a casing leak when the chemistry of the water produced is known. Based on water salinity mapping of each reservoir, a fingerprint of detected leaks can be used as evidence to prove the source of leaks.

In some embodiments, the integration of water analysis and communication-bleed down/build-up tests findings with changes in well performance parameters are useful to confirm casing leakage. The physical and chemical properties related to produce waters may have a tendency to be differ based on well location, type of hydrocarbon produced, and its temperature/pressure. Downhole techniques utilized for detecting casing leak slickline BHPT surveys and wireline logging are most reliable tools for detecting casing leaks.

FIGS. 11A-12G show the results from two example case studies involving wells studied and evaluated to determine whether a well requires a workover. Several field cases are present to illustrate casing leaks in offshore oil wells. A capture of temperature anomalies was found with a clear deviation from the baseline gradient. Based on the evaluation results, many of anomalies were related to the entry of fluids into the borehole. However, there were some cases indicated that the fluid flow was upward. The temperature was affected by the type of occupied fluid into the outside casing and by the type of movements. As a result, the temperature profile was sensitive to not only the borehole condition but also the formation type and the casing-formation annulus.

Wells completions were evaluated and interpreted their temperature profiles to capture the temperatures anomalies leading to casing leak, flow behind pipe, and a cross flow phenomena. The problems required further investigation by integrating technique with other integrity surveillance logs. In addition, the results from the workover operation with the remedial actions shared in order to validate the findings.

Figure 11A:
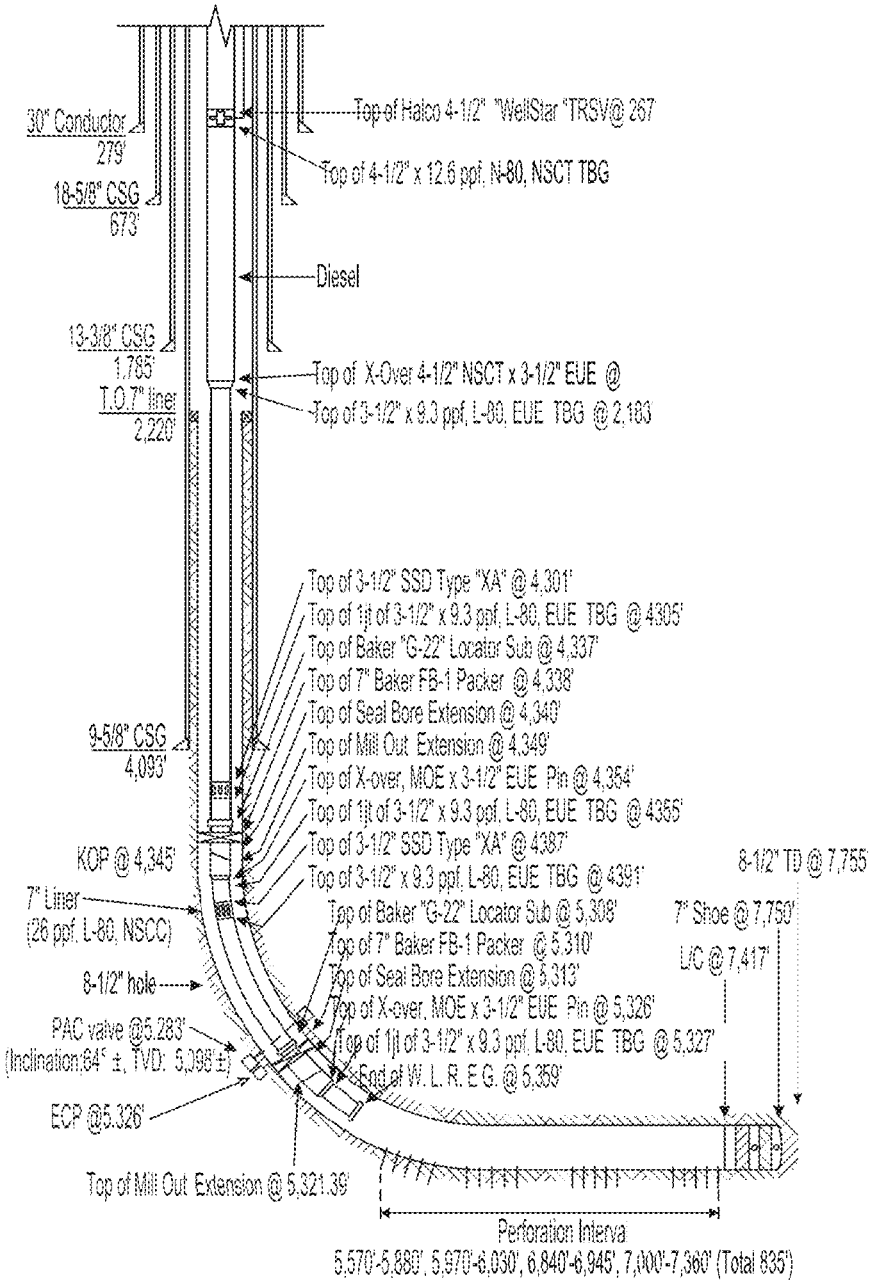
FIG. 11A shows a schematic diagram showing an assembly in accordance with one or more embodiments.

FIG. 11A shows well completion prior to any workover for a first case history. In the first case history, an offshore well was drilled and completed as a horizontal well to target a sandstone reservoir in November 2001. The well was started production naturally in June 2002 as per a designed rate with 0% water cut. BHPT surveys were plotted together for understanding temperature changes with time-lapse as indicated from the temperature anomaly at a depth from 2000-3200 ft a crossing shallow aquifer.

Figure 11B:
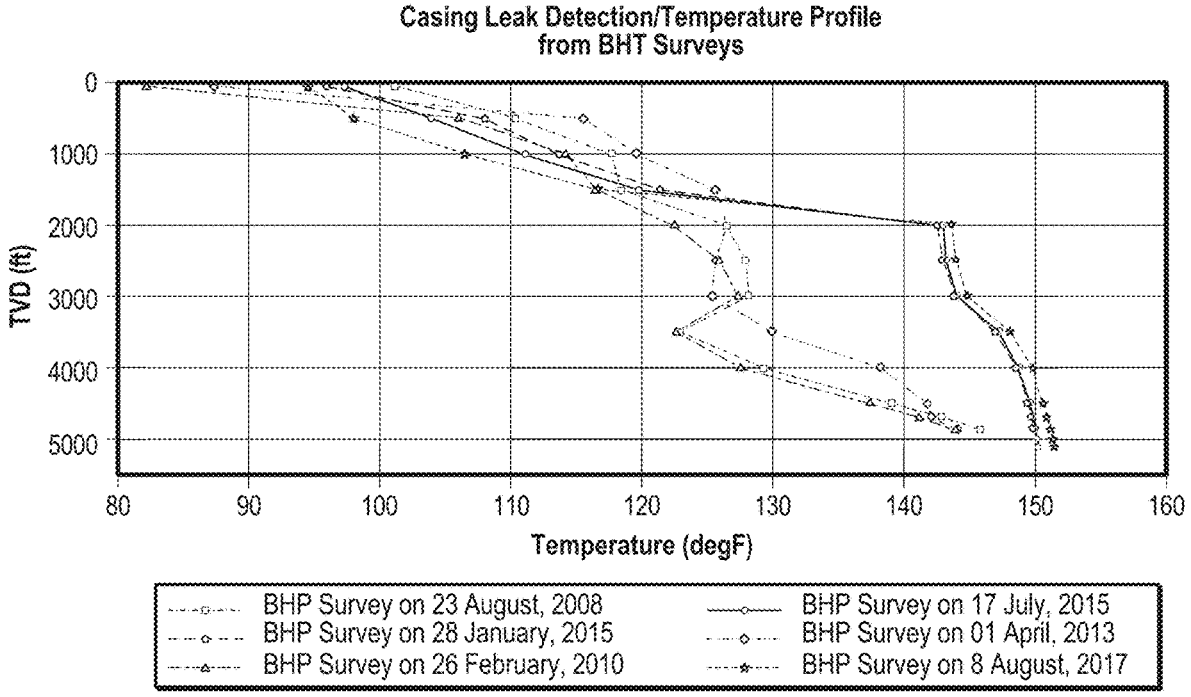
FIG. 11B shows a graph including pressure profile plots in accordance with one or more embodiments.

As shown in FIG. 11B, based on technical evaluation of temperature profile and pressure gradient of BHPT surveys in 2013, it was observed that the well showed a dumping water from shallow aquifer into reservoir as compared with previous surveys.

Figure 11C:
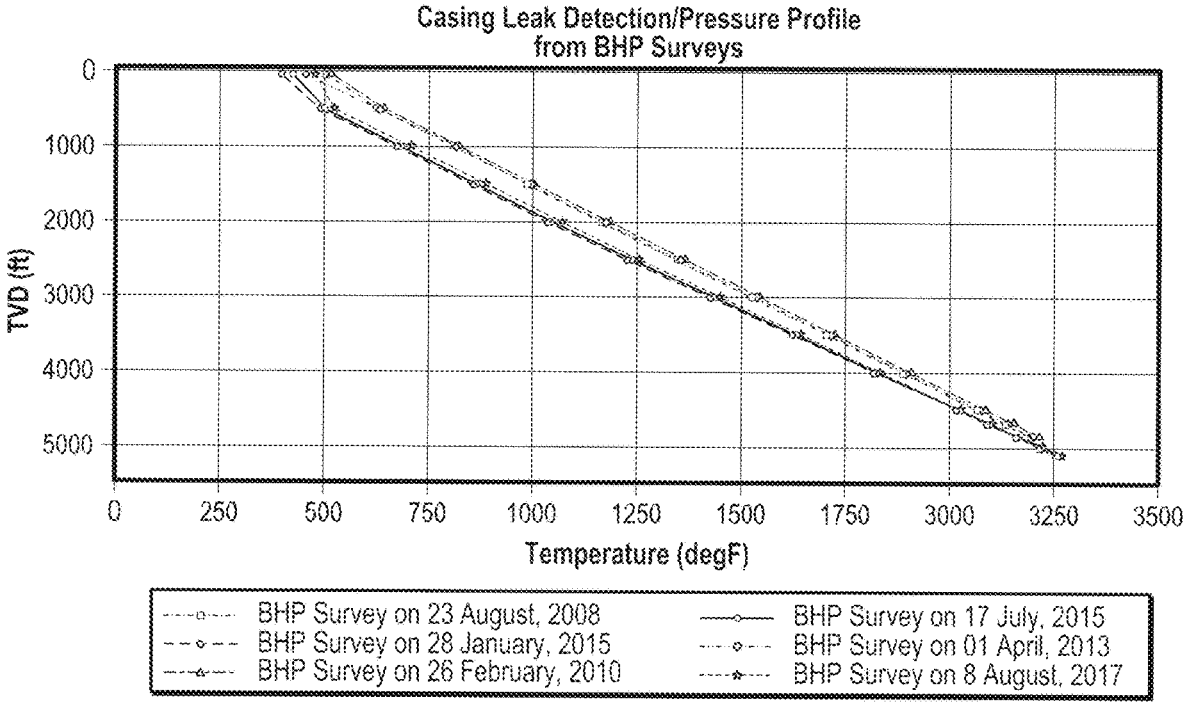
FIG. 11C shows a graph including temperature profile plots in accordance with one or more embodiments.

As shown in FIG. 11C, the well performance monitoring revealed a rapid increase in water cut trend from 22 to 40%. The wellhead parameters record indicated that annulus tubing-casing (section C between production string and production casing) pressure was 370 psi with fluid return (diesel, oil & water). The integration of the findings agreed on the issues is mainly related to a casing leak and a sustained casing pressure in section C. Therefore, the well was scheduled as workover candidate in order to improve well integrity and to restore well productivity. The objective was achieved through fixing casing leaks, fixing and repairing sustained casing pressure in section C with fluid return, and checking tubing hanger and to install gate valves at lift sides at annulus sections B & A.

Figure 11D:
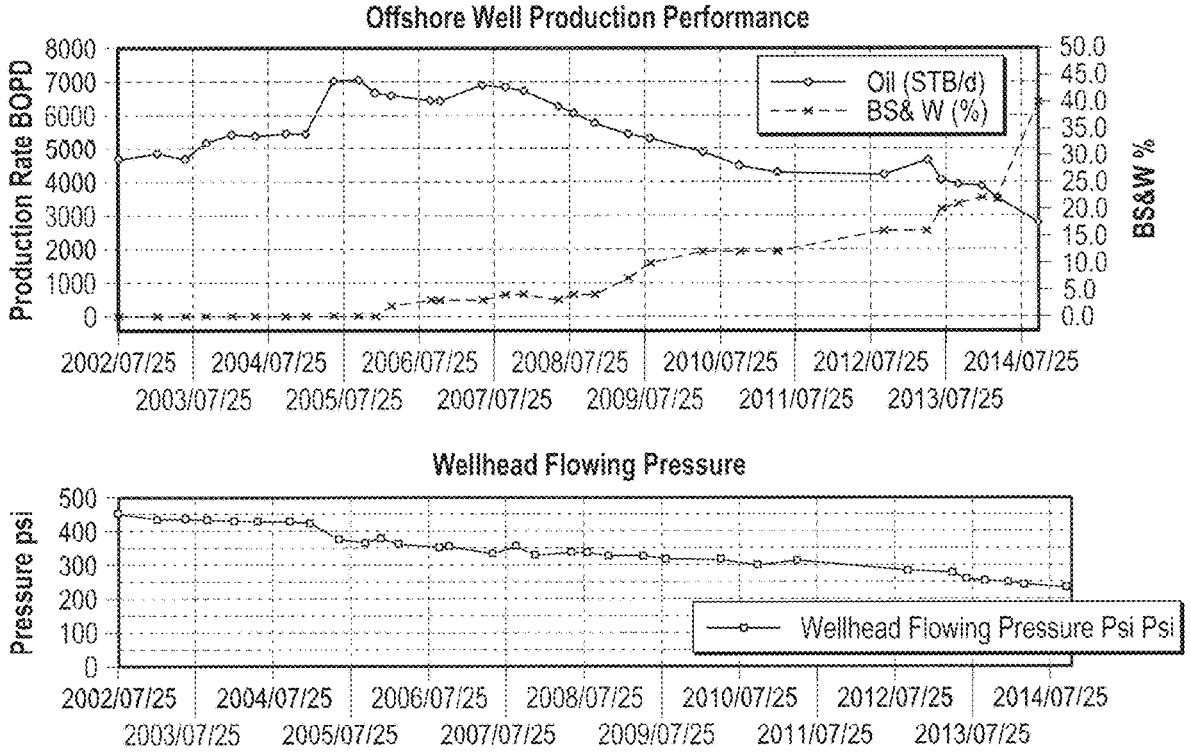
FIG. 11D shows graphs including well performance plots in accordance with one or more embodiments.

As shown in FIG. 11D, a summary of workover activities includes downhole techniques utilized for detecting casing leak. Slickline BHPT surveys and wireline logging were the most reliable tools for detecting casing leaks. During casing detection, surface campaigns and downhole techniques were implemented. During the implementation of the surface campaigns, well performance review, annuli pressure surveys, communication tests, bleed-down/build-up tests, and collected samples analysis were implemented. During the implementation of the downhole techniques, pressure/temperature surveys and logging and tooling analysis were implemented. The logging and tooling analysis included corrosion logs, electromagnetic tools, ultrasonic tools, water flow logs, and temperature logs.

In addition, workover activities included Magnetic Thickness Detector (MTD-E) logging was run to evaluate the corrosion of tubing and casing pipes from 4,270 ft to surface, pulling completion strings, Ultra Sonic Imager tool (USIT) logging for corrosion and cement evaluation across 9-⅝ inches casing and 7 inches liner. Further, a bridge plug was set at 4,035 ft inside 9-⅝ inches casing. A multi-set retrievable testing packer assembly was set to confirm a 9-⅝ inches casing leak interval from 2,203-1,863 ft and implementing injectivity with 11.5 polymer mud 4 BPM at 40 psi surface pressure and total injected volume 9 bbls.

In addition, workover activities included fixing casing leaks by remedial cement jobs and 7 inches scab liner, confirming a casing integrity with pressure test and run production tubing, interpretating corrosion logging, and conducting corrosion and cement evaluation prior to cement remedial and 7 inches scab liner job.

Figure 11E:
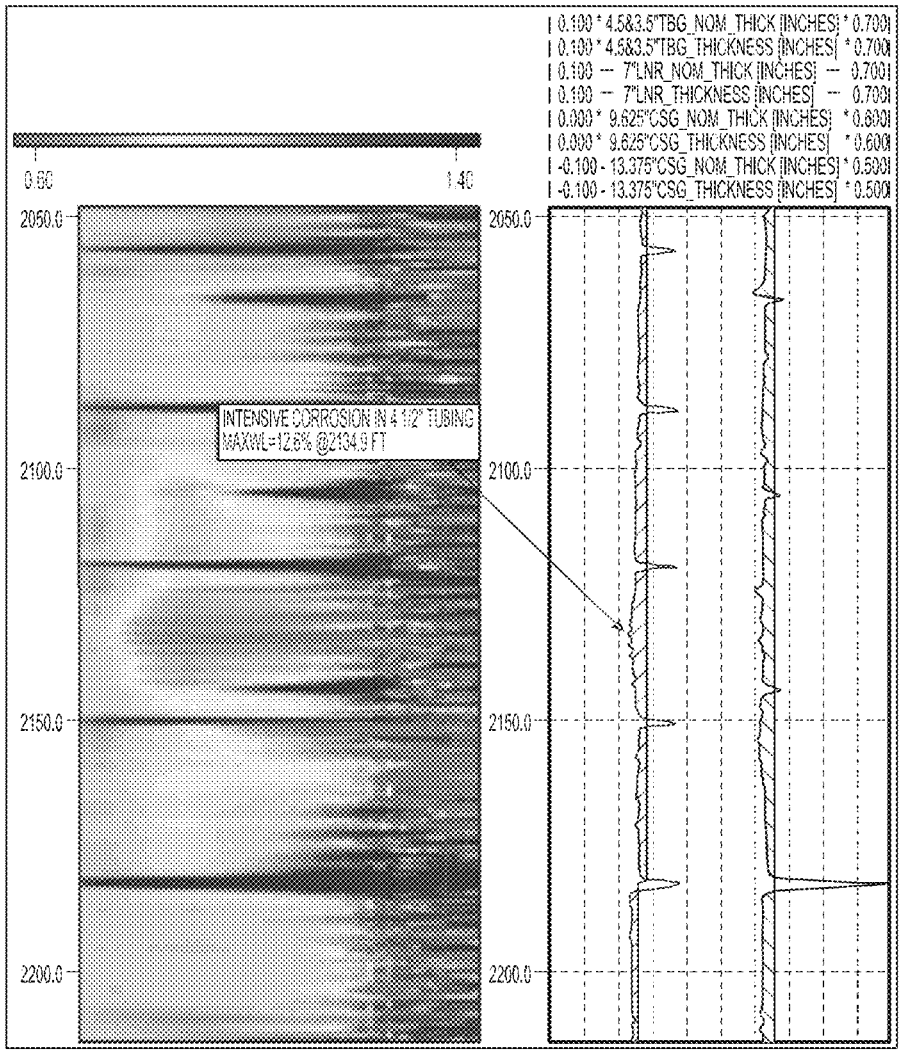
FIGS. 11E-11G show log results in accordance with one or more embodiments.

As shown in FIG. 11E, running an MTD-E log from 4,270 ft to surface, indicates that 4-½ and 3-½ inches tubing have very light to intensive corrosion. In this regard, the maximum wall loss is 12.6% in 4½ inches tubing at 2,135 ft, 7 inches liner has very light to minor corrosion and a maximum wall loss of 9.1% at 2,915 ft.

Figure 11F:
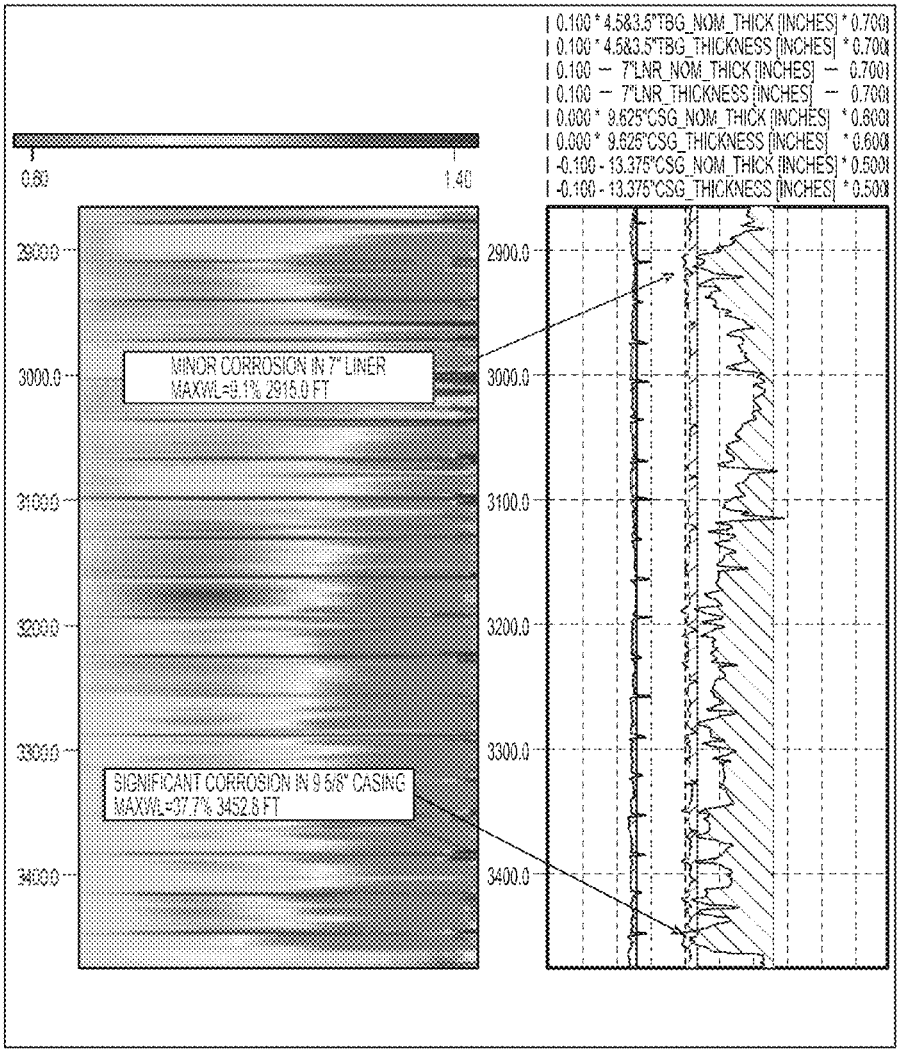

As shown in FIG. 11F, 9-⅝ inches casing has very light to significant corrosion. Maximum wall loss is 37.7% at 3,453 ft and a 13⅜ inches casing has very light to minor corrosion and a maximum wall loss of 9.3% at 168 ft.

Figure 11G:
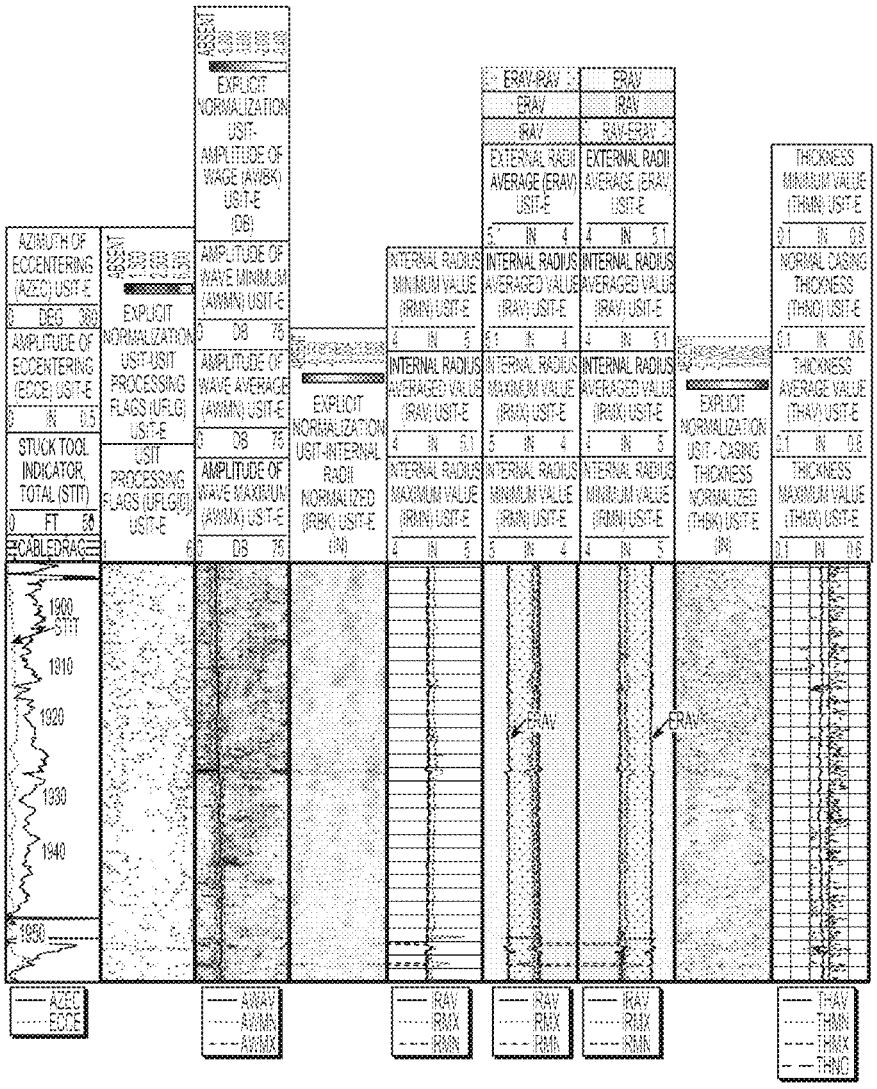

As shown in FIG. 11G, the USIT logging interval from 4,066 ft to 5,400 ft across 9-⅝ inches casing and 7 inches liner showed that at 9-⅝ inches, corrosion evaluation is found in the interval from 1,790 ft to 2,000 ft with inner pipe rugosity associated with inner pipe corrosion with 35% maximum wall loss at 1,925 ft. In this case, significant pipe anomalies were identified at 2,097 ft and with possible pipe deformation/damage. Further, a 9-⅝ inches cement evaluation revealed that poor cement distribution was observed at a range of 540-940 ft, that fair cement distribution was observed at a range of 940-1,650 ft, and that mostly good cement distribution was observed at a range of 1,650-2,220 ft. Finally, the results showed that 7 inches corrosion evaluation indicated that the 7 inches liner was mostly in good condition and that the 7 inches cement evaluation USIT identified mostly continuous galaxy pattern across entire logged interval.

Figure 11H:
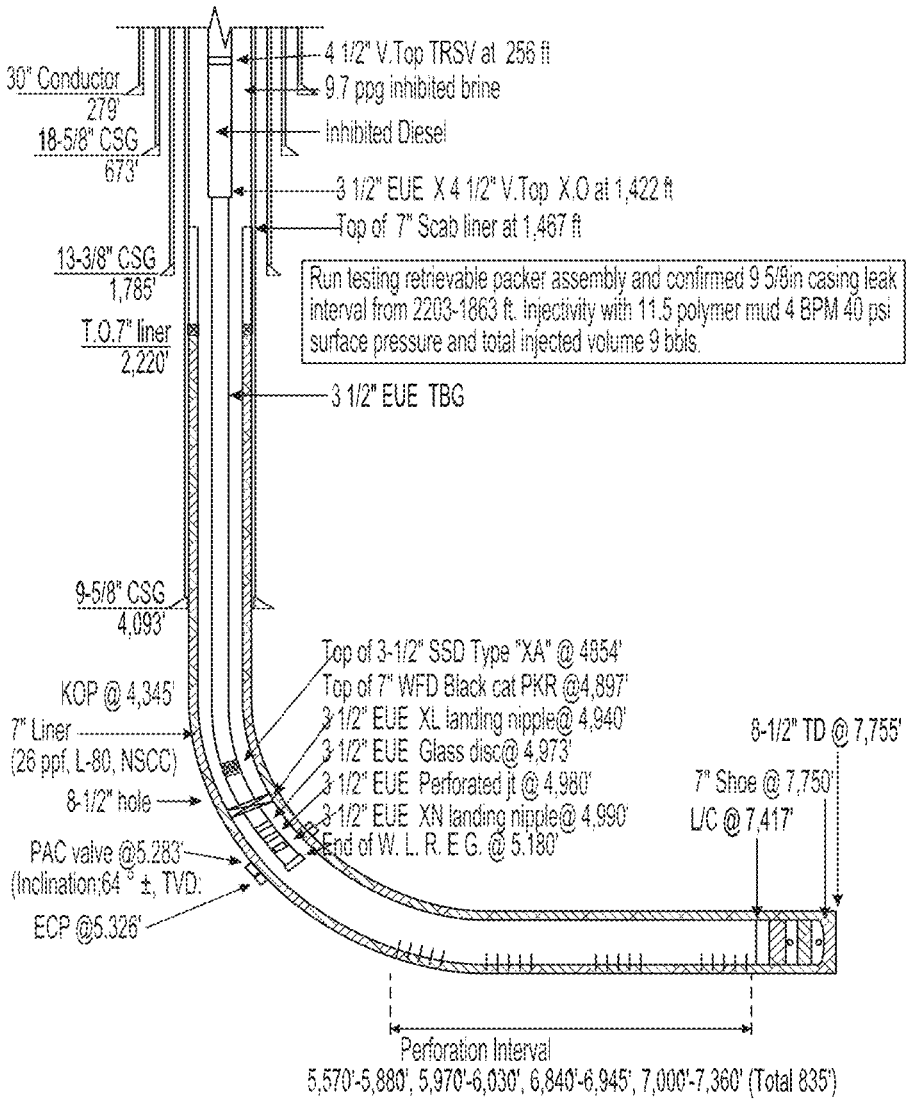
FIG. 11H shows a schematic diagram showing an assembly in accordance with one or more embodiments.

In FIG. 11H, the well from FIG. 11A is shown worked over to repair a casing leak. The casing leak was repaired by cement squeeze into the corroded 9-⅝ inches casing interval from the range of 2,203-1,863 ft in order to improve the well integrity and to restore well productivity. The result confirmed the important roles of temperature profile and pressure gradient of BHPT survey for casing leak detection, which indicated a dumping water from shallow aquifer.

Figure 12A:
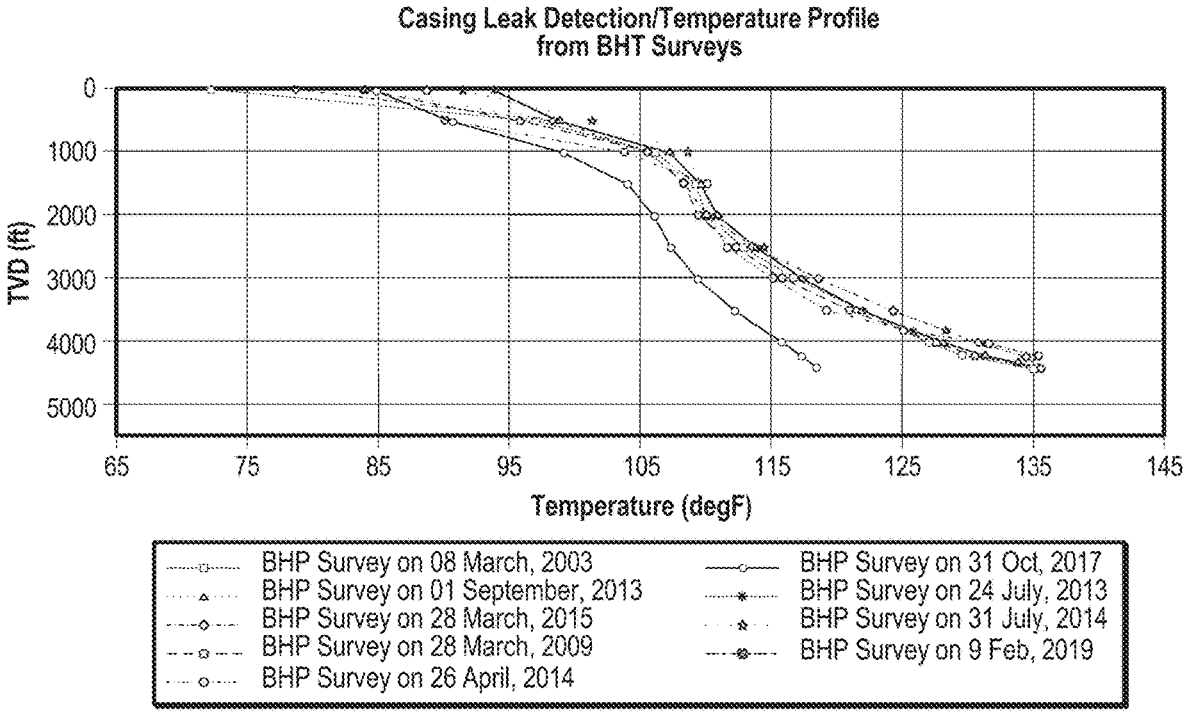
FIG. 12A shows a graph including pressure profile plots in accordance with one or more embodiments.
Figure 12B:
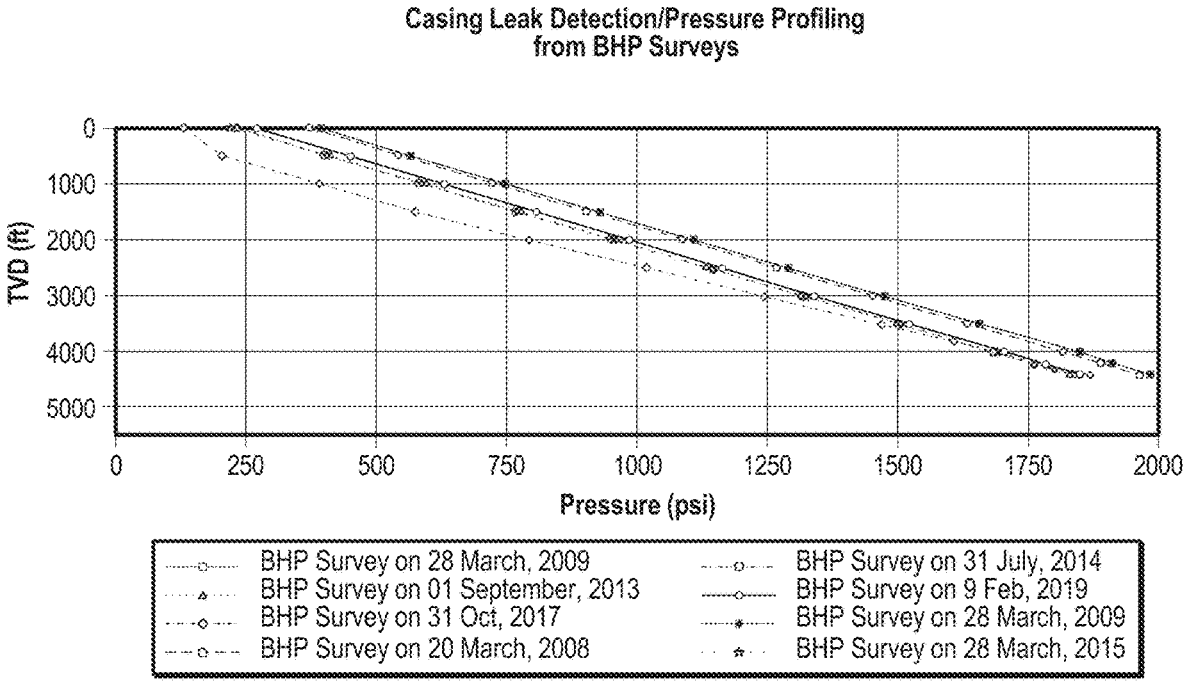
FIG. 12B shows a graph including temperature profile plots in accordance with one or more embodiments.
Figure 12C:
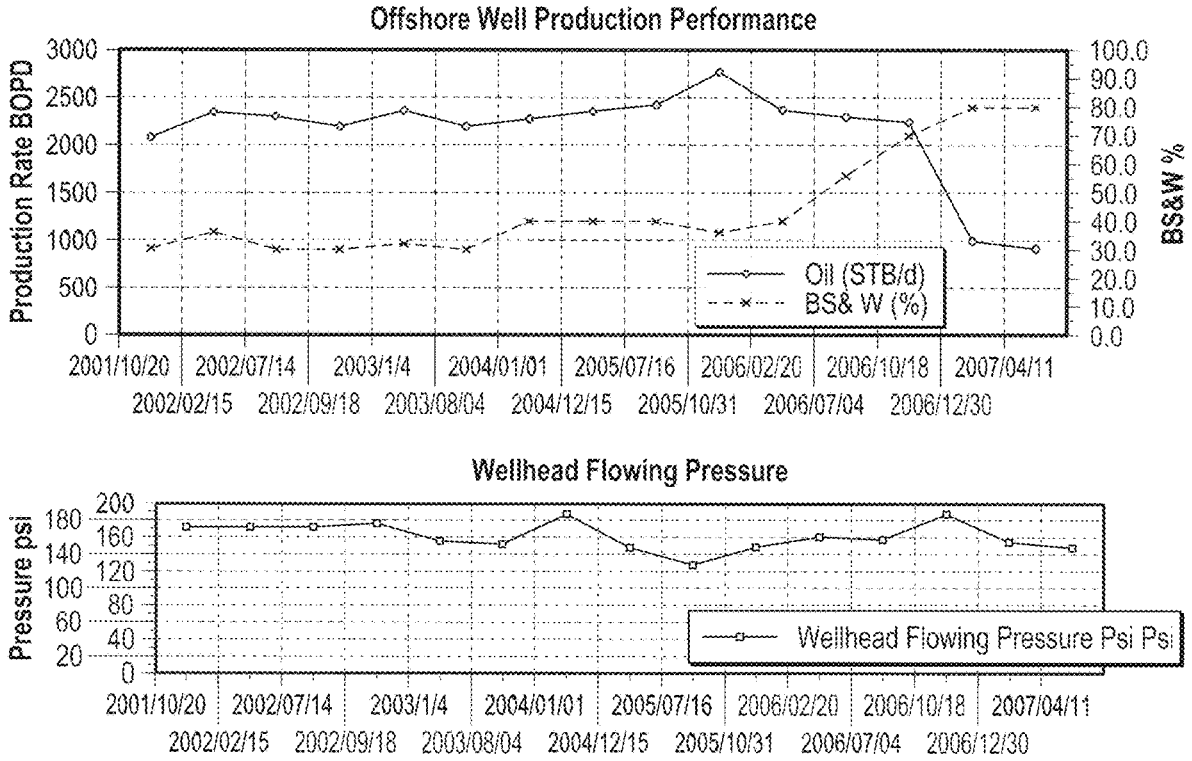
FIG. 12C shows graphs including well performance plots in accordance with one or more embodiments.

FIGS. 12A-12C shows well completion prior to any workover for a first case history. In the first case history, an offshore well was drilled and completed as a vertical well in order to target limestone reservoir in 1964. As shown in FIGS. 12A and 12B, three workovers operation jobs were conducted during the well life cycle. The first one was in 1974 to install gas lift completion. However, it was recommended to check casing integrity in 1985. In 2004, the well was also worked over to re-design gas lift completion. BHPT surveys were plotted together for understanding temperature changes with time-lapse. Based on curve analysis, it was indicated that the pressure gradient increased inside the production string at a depth 2,000 ft with a value of 0.436 psi/ft. FIG. 12C illustrates the well performance monitoring which revealed an increase in water cut trend to 80%.

Figure 12D:
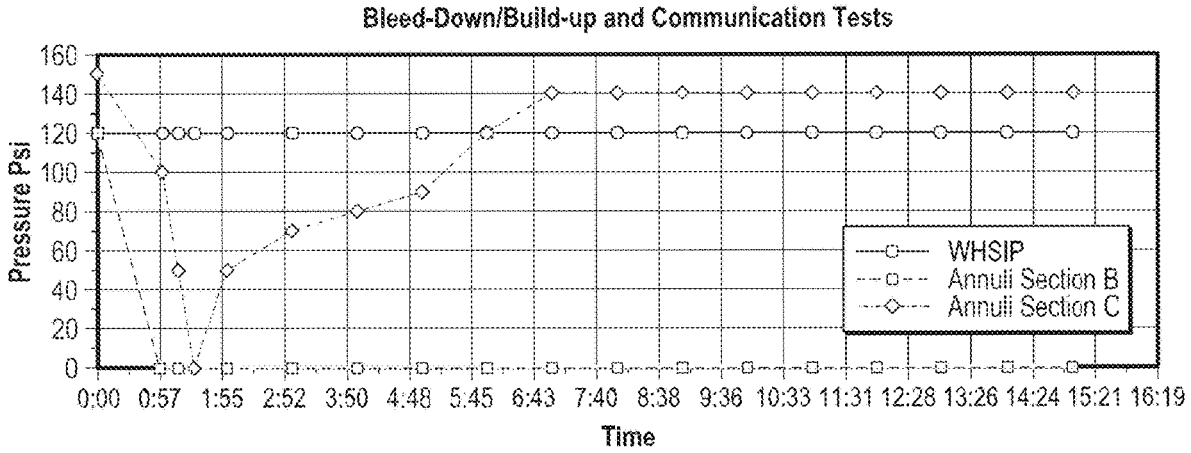
FIG. 12D shows a graph including bleed-down/build-up plots in accordance with one or more embodiments.
Figure 12E:
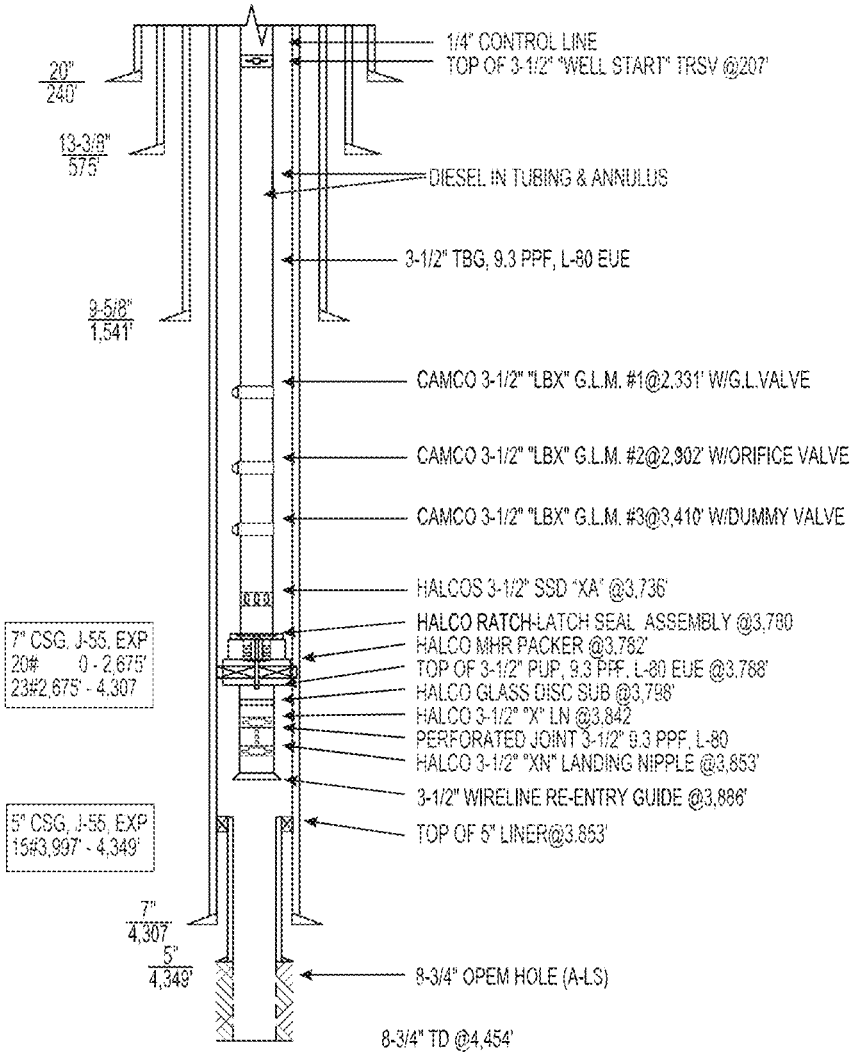
FIG. 12E shows a schematic diagram showing an assembly in accordance with one or more embodiments.

FIGS. 12D and 12E show that, based on annuli pressure surveys included a pressure bleed-down/build-up with communication tests, it was observed that a sustained casing pressure in section C with 140 psi (section C between production string and production casing) and section B was 120 psi (section B between 7 inches production casing and 9-⅝ inches casing). A test was conducted to bleed down on section B to zero pressure. The results showed there were no pressure build up observed in this section. In addition, a communication test was made on both sections of B and C which indicated no communication between annuli S/B and S/C.

In these figures, as a result of integration from the obtained findings, it was indicated that a casing leak and a sustained casing pressure in section C. Fluid samples were collected from annuli section C to identify the source of leaks. The lab results were obtained, and it showed a sweet crude oil with 28 API°. To this end, a slickline job was done to install Px-Plug inside "X" L/N nipple at 3,842 ft in order to avoid reservoir impairment.

FIG. 12E shows a well drawing prior to workover. The well was scheduled as a candidate for workover operation to improve well integrity and to restore well productivity by achieving fixing casing leak and fixing and repairing sustained casing pressure in section C with fluid return.

In addition, workover activities included pulling completion string, running an MTD-E log from 4,310 ft to a surface to evaluate the corrosion of casing pipes, implementing the USIT log for corrosion and cement evaluation across 7 inches casing, running multi-set retrievable testing packer assembly and confirmed 7 inches casing leak interval of 2,210-1,645 ft.

In addition, workover activities included performing an injectivity test with 1.5 BPM at 590 psi surface pressure, setting a bridge plug at 2,470 ft inside 7 inches casing and recording injectivity at different rates of 0.5 BPM at 370 psi, 1 BPM at 430 psi, 1.5 BPM at 480 psi, and 2 BPM at 550 psi. Further, the workover activities included fixing casing leak by remedial cement jobs and 5 inches scab liner and confirming casing integrity with pressure test and slim hole production tubing was run equipped with gas lift mandrels.

Figure 12F:
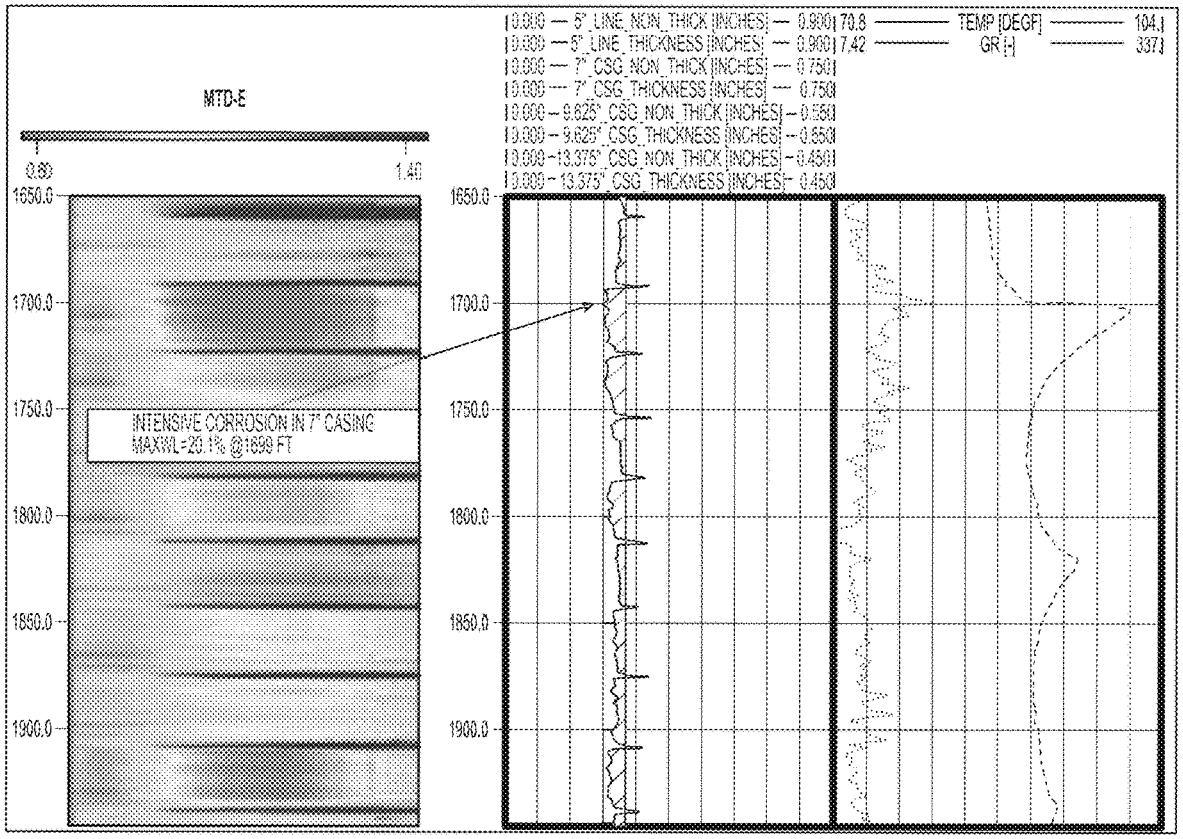
FIGS. 12F and 12G show log results in accordance with one or more embodiments.

As shown in FIG. 12F, corrosion logging interpretation includes an attempt to utilize a corrosion and cement evaluation prior to cement remedial and 5 inches scab liner job. MTD-E interpretation revealed that 13-⅜ inches, 9-⅝ inches casings and 5 inches liner have very light to minor corrosion, that 7 inches casing have very light to light corrosion, except extensive interval of 1,690-1,810 ft, at a maximum wall loss of 20.1% at 1699 ft.

Figure 12G:
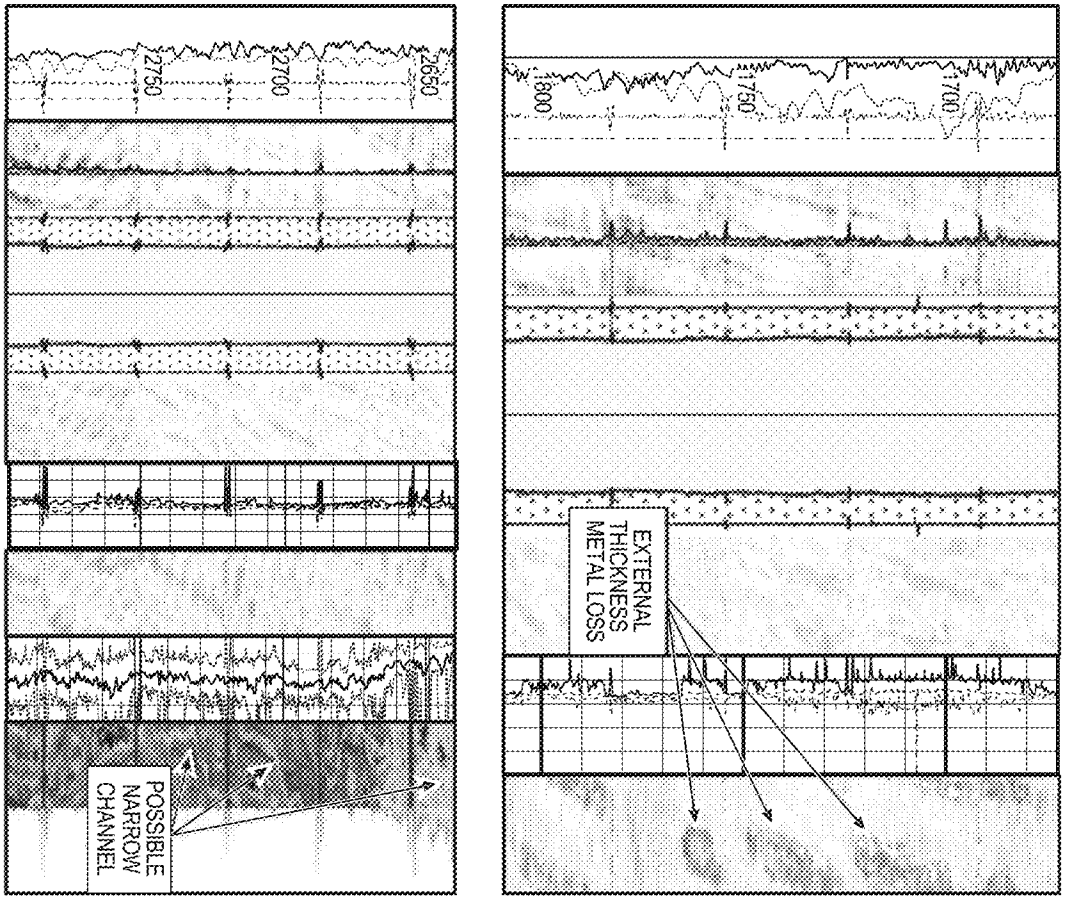

FIG. 12G shows results of a USIT logging at an interval of 4,340-4,400 ft. The logging across 5 inches liner and 7 inches casing interpretation indicated that the 7 inches casing is mostly in good condition. Some exceptions include that an intermittent external pipe metal loss was observed across an interval of 1,650-2,450 ft with a thickness metal and that a loss across this interval is flat topped at 27% across intervals such as 1,675-1765 ft, 1783-1805 ft, and 1818-1821 ft, which possibly mean that the actual metal loss is greater than measured. Further the logging showed that 7 inches cement evaluation at an interval of 40-1342 ft include mostly poor cement distribution with intermittent patches of fair cement distribution as seen at depths in intervals 70-115 ft, 150-180 ft, 1218-1280 ft, and 1342-1540 ft.

Finally, logging shows that the interval 1,540-3,990 ft includes mostly good cement distribution with a possible narrow channel and good to fair cement patches across intervals 2,572-2,660 ft or 2,615-2,625 ft. Further, the logging includes that a 5 inches liner corrosion evaluation is mostly in good condition and that a 5 inches cement evaluation in the interval 4,000-4,170 ft is mostly fair cement distribution and that the interval 4,170-4,280 ft is good-to-fair cement distribution, and that the interval 4,280-4,340 ft is mostly good cement distribution.

Figure 13:
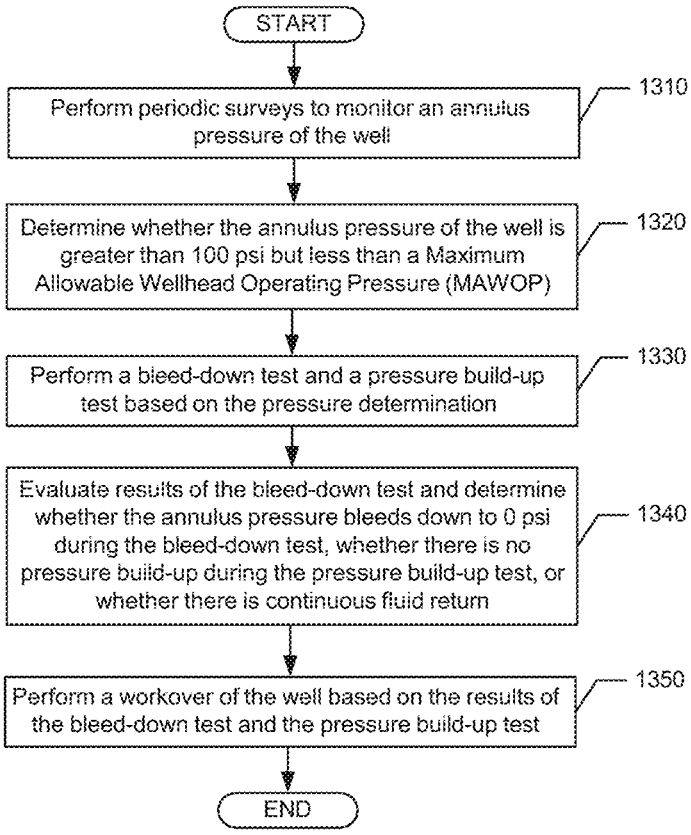
FIG. 13 shows a flowchart in accordance with one or more embodiments.

FIG. 13 shows a flowchart in accordance with one or more embodiments. Specifically, FIG. 13 describes a method for monitoring an annulus pressure of a well. In some embodiments, the method may be implemented using the control system 350 of the collection system 300 described in reference to FIG. 3. Further, one or more blocks in FIG. 13 may be performed by one or more components as described in FIGS. 1-3. While the various blocks in FIG. 13 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 1310, the collecting tool 130 performs periodic surveys to monitor an annulus pressure of a well. In some embodiments, the direction of returned fluid movement in the well may be identified based on collected returned fluid lab results. The fluid lab results may identify sources and depth of the returned fluid.

In Block 1320, the control system 350 determines whether the annulus pressure of the well is greater than 100 psi but less than a previously identified MAWOP. Pressure regulation of the annulus may include but is not limited to the use of Slickline, wireline tools, and pressure control equipment.

In Block 1330, the collecting tool 130 performs a bleed-down test and a pressure build-up test based on the pressure determination. Bleed-down tests and pressure build-up tests may be performed at any point along the depth of the annulus.

In Block 1340, the control system 350 evaluates results of the bleed-down test and determines whether the annulus pressure bleeds down to 0 psi during the bleed-down test. Further, the control system 350 determines whether there is no pressure build-up during the pressure build-up test, or whether there is continuous fluid return.

In Block 1350, an operator performs a workover of the well based on the results of the bleed-down test and the pressure build-up test.

Embodiments of the invention may be implemented using virtually any type of computing system, regardless of the platform being used. In some embodiments, the control system 350 may be computer systems located at a remote location such that data collected is processed away from the surface. In some embodiments, the computing system may be implemented on remote or handheld devices (e.g., laptop computer, smart phone, personal digital assistant, tablet computer, or other mobile device), desktop computers, servers, blades in a server chassis, or any other type of computing device or devices that includes at least the minimum processing power, memory, and input and output device(s) to perform one or more embodiments of the invention.

Figure 14:
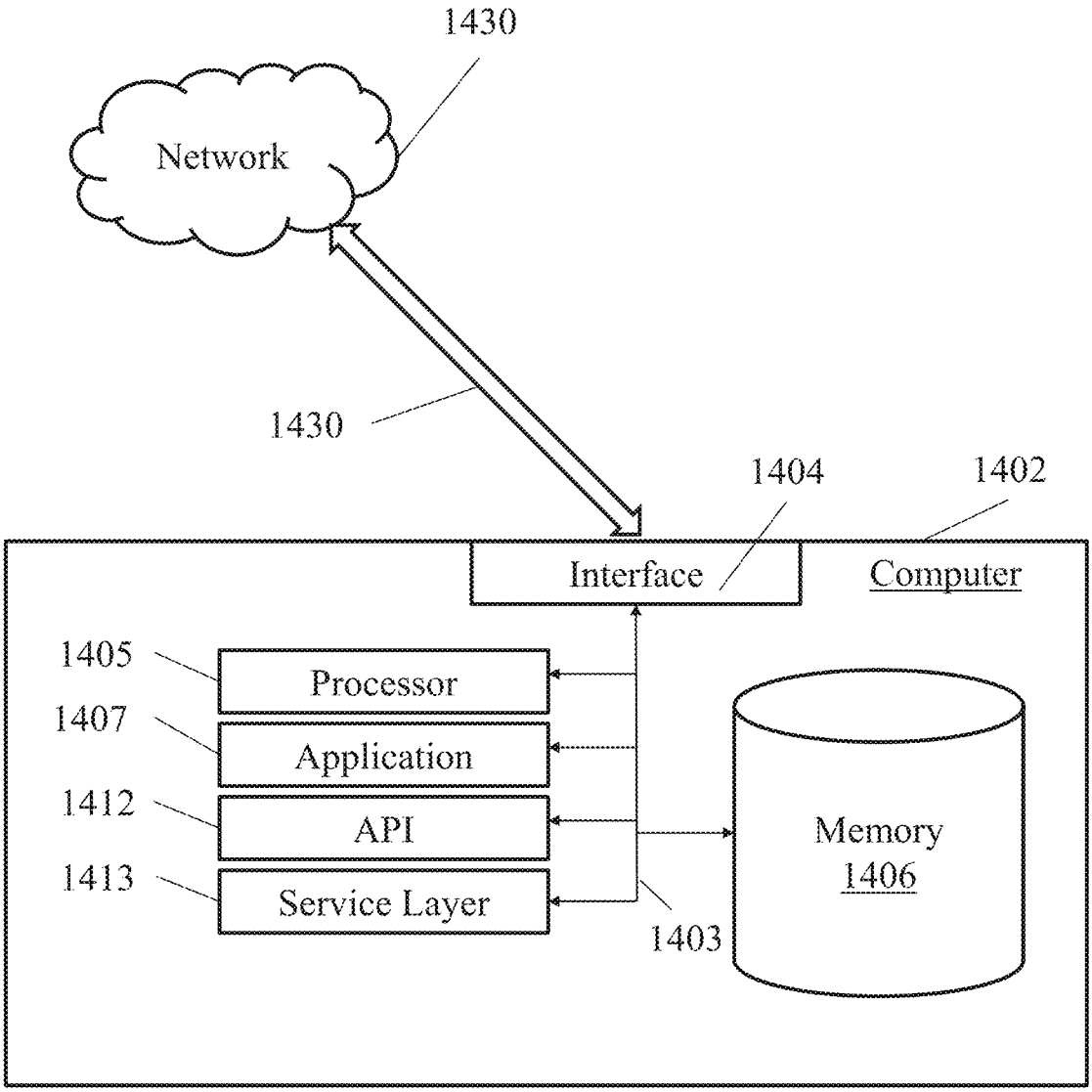
FIG. 14 shows a computer system in accordance with one or more embodiments.

FIG. 14 shows a computer (1402) system in accordance with one or more embodiments. Specifically, FIG. 14 shows a block diagram of a computer (1402) system used to provide computational functionalities associated with described algorithms, methods, functions, processes, flows, and procedures as described in the instant disclosure, according to an implementation. The illustrated computer (1402) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device.

Additionally, the computer (1402) may include a computer that includes an input device, such as a keypad, keyboard, touch screen, or other device that can accept user information, and an output device that conveys information associated with the operation of the computer (1402), including digital data, visual, or audio information (or a combination of information), or a GUI.

The computer (1402) can serve in a role as a client, network component, a server, a database or other persistency, or any other component (or a combination of roles) of a computer system for performing the subject matter described in the instant disclosure. The illustrated computer (1402) is communicably coupled with a network (1430). In some implementations, one or more components of the computer (1402) may be configured to operate within environments, including cloud-computing-based, local, global, or other environment (or a combination of environments).

At a high level, the computer (1402) is an electronic computing device operable to receive, transmit, process, store, or manage data and information associated with the described subject matter. According to some implementations, the computer (1402) may also include or be communicably coupled with an application server, e-mail server, web server, caching server, streaming data server, business intelligence (BI) server, or other server (or a combination of servers).

The computer (1402) can receive requests over network (1430) from a client application (for example, executing on another computer (1402)) and responding to the received requests by processing the said requests in an appropriate software application. In addition, requests may also be sent to the computer (1402) from internal users (for example, from a command console or by other appropriate access method), external or third-parties, other automated applications, as well as any other appropriate entities, individuals, systems, or computers.

Each of the components of the computer (1402) can communicate using a system bus (1403). In some implementations, any, or all of the components of the computer (1402), both hardware or software (or a combination of hardware and software), may interface with each other or the interface (1404) (or a combination of both) over the system bus (1403) using an application programming interface (API) (1412) or a service layer (1413) (or a combination of the API (1412) and service layer (1413). The API (1412) may include specifications for routines, data structures, and object classes. The API (1412) may be either computer-language independent or dependent and refer to a complete interface, a single function, or even a set of APIs. The service layer (1413) provides software services to the computer (1402) or other components (whether or not illustrated) that are communicably coupled to the computer (1402).

The functionality of the computer (1402) may be accessible for all service consumers using this service layer. Software services, such as those provided by the service layer (1413), provide reusable, defined business functionalities through a defined interface. For example, the interface may be software written in JAVA, C++, or other suitable language providing data in extensible markup language (XML) format or other suitable format. While illustrated as an integrated component of the computer (1402), alternative implementations may illustrate the API (1412) or the service layer (1413) as stand-alone components in relation to other components of the computer (1402) or other components (whether or not illustrated) that are communicably coupled to the computer (1402). Moreover, any or all parts of the API (1412) or the service layer (1413) may be implemented as child or sub-modules of another software module, enterprise application, or hardware module without departing from the scope of this disclosure.

The computer (1402) includes an interface (1404). Although illustrated as a single interface (1404) in FIG. 14, two or more interfaces (1404) may be used according to particular needs, desires, or particular implementations of the computer (1402). The interface (1404) is used by the computer (1402) for communicating with other systems in a distributed environment that are connected to the network (1430). Generally, the interface (1404) includes logic encoded in software or hardware (or a combination of software and hardware) and operable to communicate with the network (1430). More specifically, the interface (1404) may include software supporting one or more communication protocols associated with communications such that the network (1430) or interface's hardware is operable to communicate physical signals within and outside of the illustrated computer (1402).

The computer (1402) includes at least one computer processor (1405). Although illustrated as a single computer processor (1405) in FIG. 14, two or more processors may be used according to particular needs, desires, or particular implementations of the computer (1402). Generally, the computer processor (1405) executes instructions and manipulates data to perform the operations of the computer (1402) and any algorithms, methods, functions, processes, flows, and procedures as described in the instant disclosure.

The computer (1402) also includes a non-transitory computer (1402) readable medium, or a memory (1406), that holds data for the computer (1402) or other components (or a combination of both) that can be connected to the network (1430). For example, memory (1406) can be a database storing data consistent with this disclosure. Although illustrated as a single memory (1406) in FIG. 14, two or more memories may be used according to particular needs, desires, or particular implementations of the computer (1402) and the described functionality. While memory (1406) is illustrated as an integral component of the computer (1402), in alternative implementations, memory (1406) can be external to the computer (1402).

The application (1407) is an algorithmic software engine providing functionality according to particular needs, desires, or particular implementations of the computer (1402), particularly with respect to functionality described in this disclosure. For example, application (1407) can serve as one or more components, modules, applications, etc. Further, although illustrated as a single application (1407), the application (1407) may be implemented as multiple applications (1407) on the computer (1402). In addition, although illustrated as integral to the computer (1402), in alternative implementations, the application (1407) can be external to the computer (1402).

There may be any number of computers (1402) associated with, or external to, a computer system containing computer (1402), each computer (1402) communicating over network (1430). Further, the term "client," "user," and other appropriate terminology may be used interchangeably as appropriate without departing from the scope of this disclosure. Moreover, this disclosure contemplates that many users may use one computer (1402), or that one user may use multiple computers (1402).

The computing system in FIG. 14 may implement and/or be connected to a data repository. For example, one type of data repository is a database. A database is a collection of information configured for ease of data retrieval, modification, re-organization, and deletion. In some embodiments, the database includes published/measured data relating to the method and the system as described in reference to FIGS. 1-14.

While FIGS. 1-14 show various configurations of components, other configurations may be used without departing from the scope of the disclosure. For example, various components in FIG. 1-3 may be combined to create a single component. As another example, the functionality performed by a single component may be performed by two or more components.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. A method for monitoring an annulus pressure of a well, the method comprising:

performing periodic surveys to monitor an annulus pressure of the well;

determining the annulus pressure of the well over a period of time;

comparing the annulus pressure to a Maximum Allowable Wellhead Operating Pressure (MAWOP);

generating a decision on whether the well is a workover candidate well based on results of the comparison;

identifying, based on the comparison, that the annulus pressure is less than 100 psi;

generating the decision indicating that the well is not the workover candidate well;

storing information indicating that the annulus pressure is not the workover candidate well over the period of time; and determining the annulus pressure over another period of time.

2. The method of claim 1, the method further comprising:

performing a remedial action or a workover when the decision indicates that the well is the workover candidate well.

3. The method of claim 1, the method further comprising:

performing a bleed-down test and a pressure build-up test when the annulus pressure is greater than 100 psi but less than the MAWOP.

4. The method of claim 3, the method further comprising:

evaluating results of the bleed-down test and the pressure build-up test;

identifying that the well does not require a remedial action or a workover; and generating the decision on whether the well is a workover candidate well based on the results of the comparison and based on the results of the bleed-down test and the pressure build-up test.

5. The method of claim 3, the method further comprising:

evaluating results of the bleed-down test and the pressure build-up test;

determining whether the annulus pressure bleeds down to 0 psi;

identifying that the well does not require a remedial action or a workover; and generating the decision on whether the well is the workover candidate well based on the results of the comparison and based on the results of the bleed-down test and the pressure build-up test.

6. The method of claim 3, the method further comprising:

evaluating results of the bleed-down test and the pressure build-up test;

determining whether there is no pressure build-up in the annulus;

identifying that the well does not require a remedial action or a workover; and generating the decision on whether the well is the workover candidate well based on the results of the comparison and based on the results of the bleed-down test and the pressure build-up test.

7. The method of claim 3, the method further comprising:

evaluating results of the bleed-down test and the pressure build-up test;

determining whether there is no continuous fluid return in the annulus;

identifying that the well does not require a remedial action or a workover; and generating the decision on whether the well is the workover candidate well based on the results of the comparison and based on the results of the bleed-down test and the pressure build-up test.

8. The method of claim 3, the method further comprising:

identifying, based on the comparison and based on the bleed-down test and the pressure build-up test, that the well does not require a remedial action or a workover when the annulus pressure is less than 100 psi and there is no fluid return;

generating the decision indicating that the well is not the workover candidate well;

storing information indicating that the annulus pressure is not the workover candidate well over the period of time; and determining the annulus pressure over another period of time.

9. The method of claim 3, the method further comprising:

identifying, based on the comparison and based on the bleed-down test and the pressure build-up test, that the annulus pressure is greater than 100 psi but less than MAWOP and that the annulus pressure bleeds down to 0 psi;

generating the decision indicating that the well is not the workover candidate well;

storing information indicating that the annulus pressure is not the workover candidate well over the period of time; and determining the annulus pressure over another period of time.

10. The method of claim 1, the method further comprising:

determining that the annulus pressure is greater than the MAWOP;

identifying that the well requires a remedial action or a workover;

generating the decision indicating that the well is the workover candidate well; and performing the remedial action or the workover.

11. A system for monitoring an annulus pressure of a well, the system comprising:

a collecting tool that:

performs periodic surveys to monitor an annulus pressure of the well, determines the annulus pressure of the well over a period of time, broadcasts information relating to the periodic surveys; and determines the annulus pressure over another period of time; and a processor that:

obtains the information relating the periodic surveys, compares the annulus pressure to a Maximum Allowable Wellhead Operating Pressure (MAWOP), generates a decision on whether the well is a workover candidate well based on the results of the comparison, identifies that the annulus pressure is less than 100 psi, generates the decision indicating that the well is not a workover candidate well, and stores information indicating that the annulus pressure is not the workover candidate well over the period of time.

12. The system of claim 11, the system further comprising:

a transmitter that transmits the decision to an operator, wherein the operator performs a remedial action or a workover when the decision indicates that the well is the workover candidate well.

13. The system of claim 11, wherein the processor further:

instructs the collecting tool to perform a bleed-down test and a pressure build-up test when the annulus pressure is greater than 100 psi but less than the MAWOP.

14. The system of claim 13, wherein the collecting tool further:

performs the bleed-down test and the pressure build-up test upon receiving the instruction from the processor, and transmits results of the bleed-down test and the pressure build-up test to the processor.

15. The system of claim 14, wherein the processor further:

evaluates results of the bleed-down test and the pressure build-up test;

identifies that the well does not require a remedial action or a workover; and generates the decision on whether the well is the workover candidate well based on the results of the comparison and based on the results of the bleed-down test and the pressure build-up test.

16. The system of claim 14, wherein the processor further:

evaluates results of the bleed-down test and the pressure build-up test;

determines whether the annulus pressure bleeds down to 0 psi;

identifies that the well does not require a remedial action or a workover; and generating the decision on whether the well is the workover candidate well based on the results of the comparison and based on the results of the bleed-down test and the pressure build-up test.

17. The system of claim 14, wherein the processor further:

evaluates results of the bleed-down test and the pressure build-up test;

determines whether there is no pressure build-up in the annulus;

identifies that the well does not require a remedial action or a workover; and generates the decision on whether the well is the workover candidate well based on the results of the comparison and based on the results of the bleed-down test and the pressure build-up test.

18. The system of claim 14, wherein the processor further:

evaluates results of the bleed-down test and the pressure build-up test;

determines whether there is no continuous fluid return in the annulus;

identifies that the well does not require a remedial action or a workover; and generates the decision on whether the well is the workover candidate well based on the results of the comparison and based on the results of the bleed-down test and the pressure build-up test.

19. A non-transitory computer readable medium storing instructions executable by a computer processor, the instructions comprising functionality for:

performing periodic surveys to monitor an annulus pressure of the well;

determining the annulus pressure over a period of time;

comparing the annulus pressure to a Maximum Allowable Wellhead Operating Pressure (MAWOP);

performing a bleed-down test and a pressure build-up test when the annulus pressure is greater than 100 psi but less than the MAWOP;

evaluating results of the bleed-down test and the pressure build-up test;

identifying that the well does not require a remedial action or a workover;

generating a decision on whether the well is a workover candidate well based on the results of the comparison and based on the results of the bleed-down test and the pressure build-up test; and performing the remedial action or the workover when the decision indicates that the well is the workover candidate well.

* * * * *